US009312618B2

(12) United States Patent
Regnier et al.

(10) Patent No.: US 9,312,618 B2
(45) Date of Patent: Apr. 12, 2016

(54) CONNECTOR WITH TUNED CHANNEL

(75) Inventors: Kent E. Regnier, Lombard, IL (US); Patrick R. Casher, North Aurora, IL (US)

(73) Assignee: Molex, LLC, Lisl, IL (US)

( * ) Notice: Subject to any disclaimer, the term of this patent is extended or adjusted under 35 U.S.C. 154(b) by 0 days.

(21) Appl. No.: 14/237,508

(22) PCT Filed: Aug. 7, 2012

(86) PCT No.: PCT/US2012/049856
§ 371 (c)(1),
(2), (4) Date: May 9, 2014

(87) PCT Pub. No.: WO2013/022889
PCT Pub. Date: Feb. 14, 2013

(65) Prior Publication Data

US 2015/0207247 A1 Jul. 23, 2015

Related U.S. Application Data

(60) Provisional application No. 61/521,245, filed on Aug. 8, 2011, provisional application No. 61/542,620, filed on Oct. 3, 2011.

(51) Int. Cl.
*H01R 12/00* (2006.01)
*H01R 12/71* (2011.01)
(Continued)

(52) U.S. Cl.
CPC ..... *H01R 12/71* (2013.01); *H01R 9/2408* (2013.01); *H01R 12/724* (2013.01); *H01R 13/6586* (2013.01)

(58) Field of Classification Search
CPC ..... H01R 23/7073; H01R 23/722; H01R 23/725; H01R 9/091; H01R 9/096; H01R 12/57; H01R 12/585; H05K 3/366
USPC ..... 439/78, 65
See application file for complete search history.

(56) References Cited

U.S. PATENT DOCUMENTS 4,693,531 A * 9/1987 Raphal et al. ..... 439/512
4,972,505 A * 11/1990 Isberg ..... 455/3.01
(Continued)

FOREIGN PATENT DOCUMENTS

JP 06-215829 A 8/1994
JP 2003-031317 A 1/2003
(Continued)

OTHER PUBLICATIONS

International Search Report for PCT/US2012/049856.

*Primary Examiner* — Abdullah Riyami
*Assistant Examiner* — Vladimir Imas
(74) *Attorney, Agent, or Firm* — Stephen L. Sheldon

(57) ABSTRACT

A connector is provided that includes a housing and the housing supports a plurality of wafers. Each wafer supports a terminal and adjacent signal wafers are configured so as to provide broad-side coupled terminals. A pair of signal terminals can be surrounded on both sides by ground terminals that offer shielding so as to help isolate one signal pair from another signal pair. The geometry of the wafers can be adjusted so as to provide a tuned transmission channel. The resultant tuned transmission channel can be configured to provide desirable performance at high signaling frequencies of 12-16 GHz or even higher signaling frequencies such as 20 GHz.

18 Claims, 35 Drawing Sheets

(51) Int. Cl.

| | |
|---|---|
| ***H01R 9/24*** | (2006.01) |
| ***H01R 12/72*** | (2011.01) |
| ***H01R 13/6586*** | (2011.01) |

(56) References Cited

U.S. PATENT DOCUMENTS

| | | | | |
|---|---|---|---|---|
| 5,537,292 | A * | 7/1996 | Bowen | 361/737 |
| 6,231,391 | B1 * | 5/2001 | Ramey et al. | 439/607.07 |
| 6,435,914 | B1 * | 8/2002 | Billman | 439/607.07 |
| 6,709,298 | B2 | 3/2004 | Bradley | |
| 6,811,440 | B1 * | 11/2004 | Rothermel et al. | 439/79 |
| 6,863,543 | B2 | 3/2005 | Lang et al. | |
| 7,044,793 | B2 * | 5/2006 | Takemasa | 439/607.07 |
| 7,097,506 | B2 * | 8/2006 | Nakada | 439/607.39 |
| 7,198,519 | B2 | 4/2007 | Regnier et al. | |
| 7,200,856 | B2 * | 4/2007 | Perlman | 725/82 |
| 7,422,483 | B2 | 9/2008 | Avery et al. | |
| 7,553,190 | B2 | 6/2009 | Laurx et al. | |
| 7,588,463 | B2 * | 9/2009 | Yamada et al. | 439/607.05 |
| 7,621,779 | B2 | 11/2009 | Laurx et al. | |
| 7,727,017 | B2 * | 6/2010 | Amleshi et al. | 439/607.11 |
| 7,758,357 | B2 * | 7/2010 | Pan et al. | 439/108 |
| 7,841,900 | B2 * | 11/2010 | Liu et al. | 439/607.07 |
| 7,862,376 | B2 * | 1/2011 | Sypolt et al. | 439/607.07 |
| 7,871,296 | B2 * | 1/2011 | Fowler et al. | 439/607.09 |
| 7,883,367 | B1 | 2/2011 | Kline | |
| 7,976,321 | B2 * | 7/2011 | Schempp | 439/108 |
| 8,147,274 | B2 * | 4/2012 | Mizukami | 439/607.07 |
| 8,465,302 | B2 | 6/2013 | Regnier et al. | |
| 8,753,148 | B2 * | 6/2014 | Wozniak | 439/607.05 |
| 8,864,521 | B2 * | 10/2014 | Atkinson et al. | 439/607.07 |
| 8,920,194 | B2 * | 12/2014 | Minich | 439/607.05 |
| 2002/0160658 | A1 * | 10/2002 | Sipe | 439/608 |
| 2004/0067690 | A1 * | 4/2004 | Varis | 439/608 |
| 2009/0011620 | A1 | 1/2009 | Avery et al. | |
| 2012/0003848 | A1 | 1/2012 | Casher et al. | |
| 2015/0061046 | A1 * | 3/2015 | Chang et al. | 257/415 |
| 2015/0163923 | A1 * | 6/2015 | Currie et al. | 29/846 |

FOREIGN PATENT DOCUMENTS

| | | | |
|---|---|---|---|
| JP | 2004-274047 | A | 9/2004 |
| JP | 2005-526354 | A | 9/2005 |

* cited by examiner

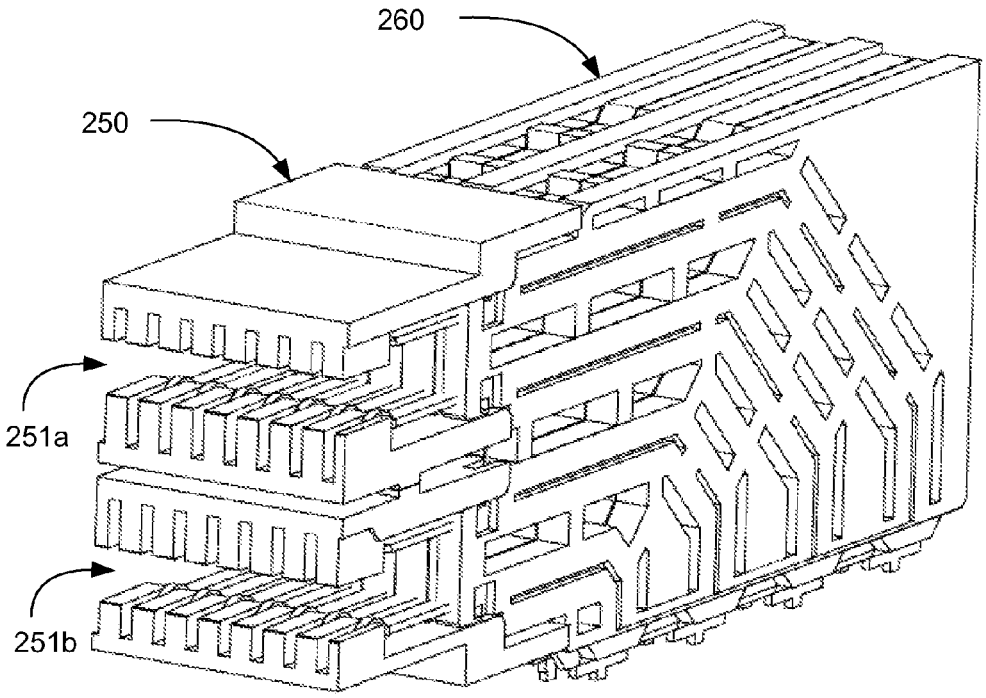
Fig. 27
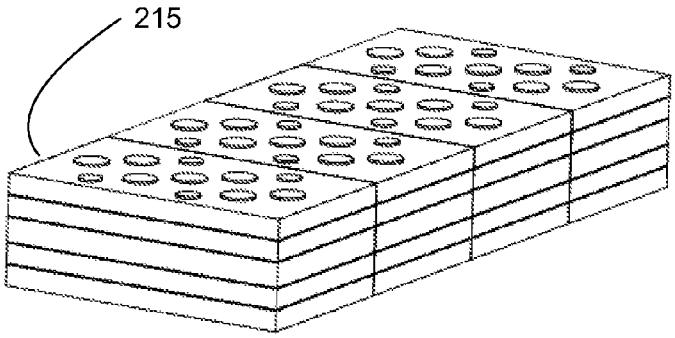

CONNECTOR WITH TUNED CHANNEL

RELATED APPLICATIONS

This application claims priority to U.S. Provisional Application No. 61/521,245, filed Aug. 8, 2011, and U.S. Provisional Application No. 61/542,620, filed Oct. 3, 2011, both of which are incorporated herein by reference in their entirety.

FIELD OF THE INVENTION

The present invention relates to the field of connectors, more specifically to the field of connectors suitable for higher data rates.

DESCRIPTION OF RELATED ART

Connectors suitable for moderately high data rates are known. For example, the Infiniband Trade Association has approved a standard that requires a 10 Gbps per channel, 12 channel connector. Similar connectors have or are in the process of being approved for use in other standards. In addition, connectors that offer 10 Gbps per channel in a 4 channel system are also in use (e.g., QSFP style connectors). While these existing connectors are well suited for use in 10 Gbps channels, future communication requirements are expected to require data rates such as 16 Gbps or 25 Gbps. Existing IO connectors are simply not designed so as to be able to meet these requirements and to properly support these higher data rates. Furthermore, existing techniques to provide great performance are either costly or have other negative side effects. Consequentially, further improvements in a connector system would be appreciated by certain individuals.

BRIEF SUMMARY

A connector is provided with a tuned data channel. The data channel can include wafers that support multiple terminals. Terminals in adjacent wafers are configured to be broadside coupled together. The wafer structure and the respective terminals are configured to provide a tuned channel that can support relatively fast data rates. In an embodiment the tuning can be configured to be different for different length channels. In another embodiment, the tuning can be different for ground and signal wafers.

BRIEF DESCRIPTION OF THE DRAWINGS

The present invention is illustrated by way of example and not limited in the accompanying figures in which like reference numerals indicate similar elements and in which:

FIG. 27 illustrates a simplified partially exploded perspective view of the embodiment depicted in FIG. 25.

DETAILED DESCRIPTION

Figure 1:
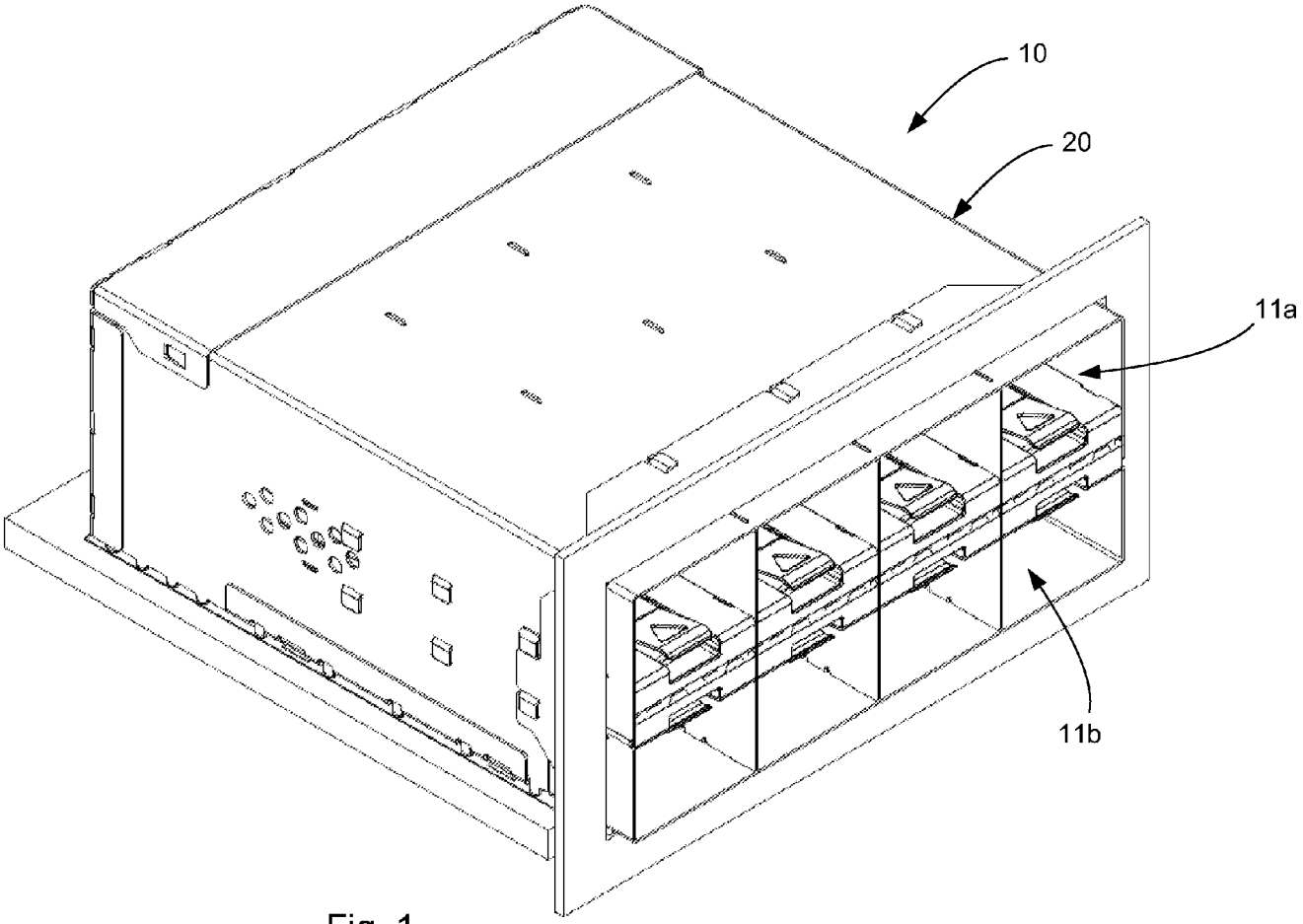
FIG. 1 illustrates a perspective view of an embodiment of an exemplary connector system.
Figure 2:
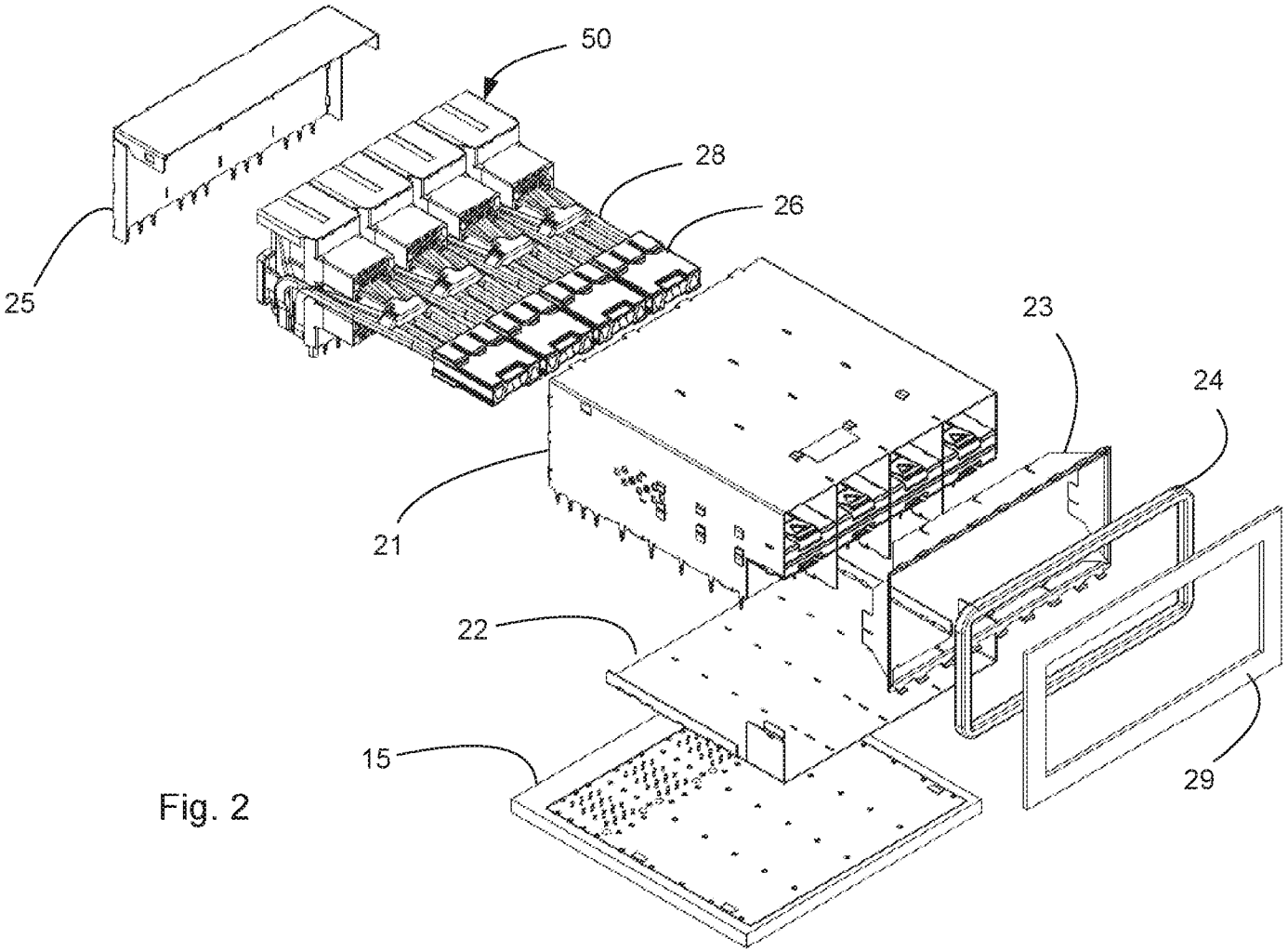
FIG. 2 illustrates a perspective exploded view of the embodiment depicted in FIG. 1.
Figure 3:
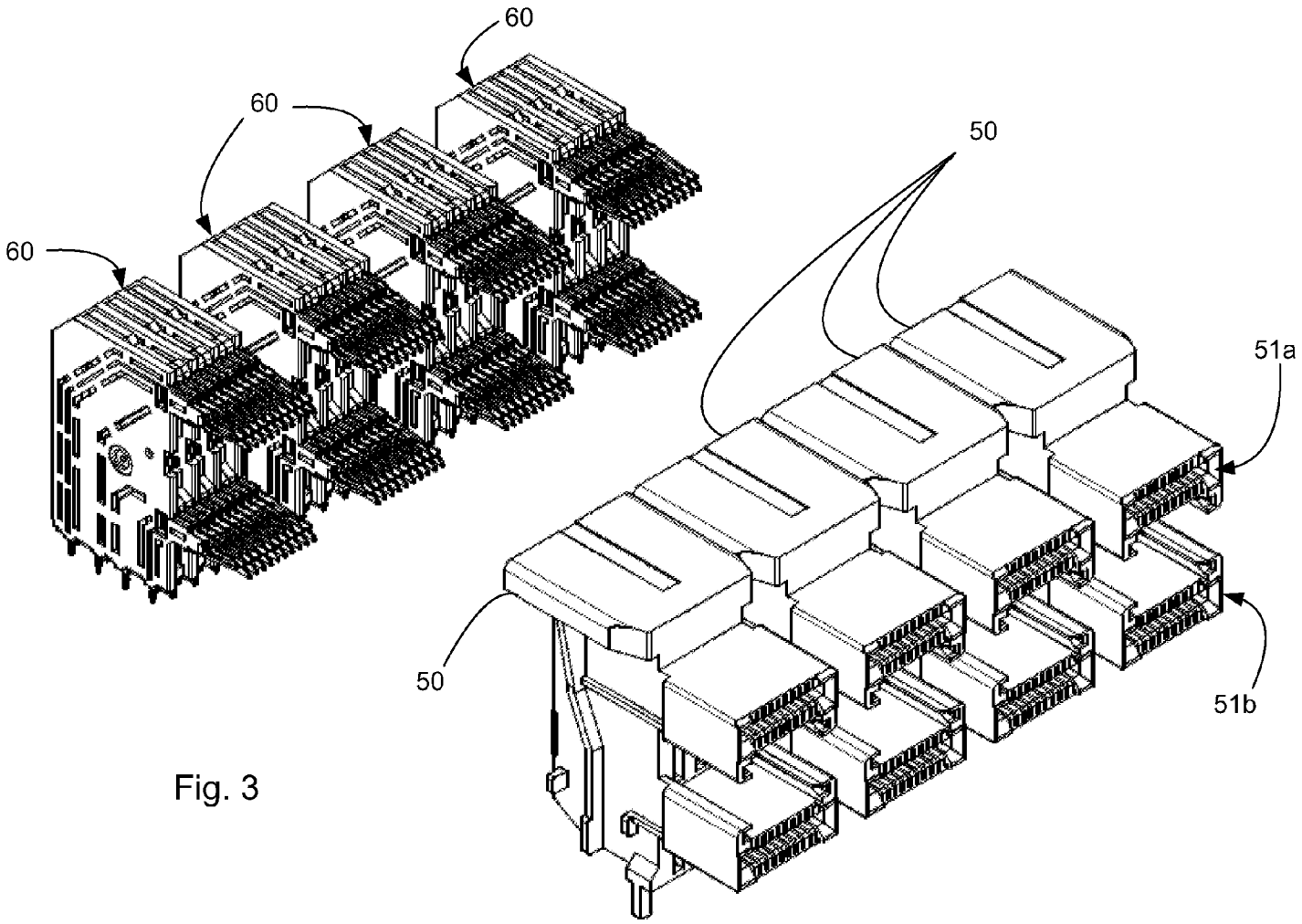
FIG. 3 illustrates a perspective view of a partially exploded simplified connector system.
Figure 4:
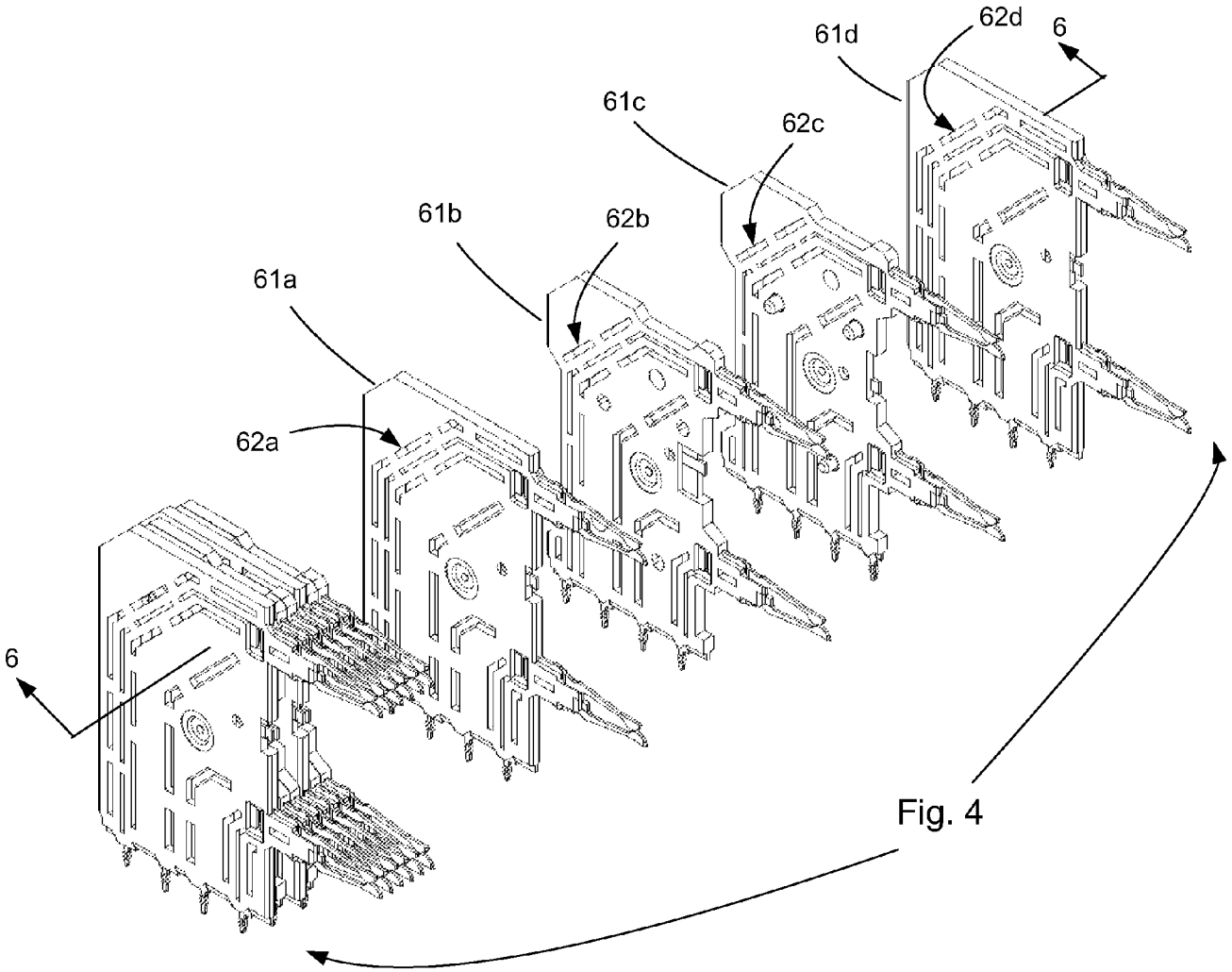
FIG. 4 illustrates a partially exploded perspective view of an embodiment of a set of wafers.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated by the Figures disclosed herein, certain embodiments are disclosed that include housing and cages that provide stacked IO ports. Stacking ports allows the density of cable connectors that can be coupled to a board through the receptacle to be increased. However, the features disclosed herein are not limited to a stacked receptacle as certain features could readily be used for single port receptacles (which may or may not have two card slots in each port) and could also be used for designs where more than two ports are stacked. It has been determined that for most situations, if the ports are all intended to offer the same functionality then two stacked ports provides the greatest performance versus cost (at least from a receptacle standpoint). Naturally, system level performance and costs may drive different results.

As can be appreciated, in the depicted embodiment terminal grooves are provided along the path of the terminals. In general, the use of terminal grooves has proven useful to help control the dielectric constant of a terminal and has been used to help manage skew and/or to help control coupling between two terminals. However, to date these efforts have not fully addressed issues that result when signaling frequencies are increased. For example, as data rats approach 28 Gbps in a NRZ encoded system, it is helpful that a connector system performs well out to 14 GHz and preferable in many applications that the connector system perform well out to 20-21 GHz (e.g., the Nyquist frequency).

For very short connectors, such as SMT style receptacles with a single card slot, it is possible to minimize the technical issues in part because the connector is so short, electrically speaking. However, as the electrical length of the terminals increases, resonances can be caused by cross talk between terminal and reflected energy at the interfaces of the receptacle connector (e.g., between the receptacle connector and a support circuit board and between the receptacle connector and a mating plug connector). Therefore, to address this, sometimes connectors will be provided with pins or other electrical elements that help common the ground terminals. This helps shorten the electrical path of the ground terminals and generally helps avoid resonances at signaling frequencies of interest that would otherwise be caused by the unintended modes created in the ground terminals as the energy that provides the signals pass through the signal terminals. In addition, certain individuals have attempted to address the energy carried in the ground terminal by adding lossy material.

While the above methods can be helpful, it has been determined that they have certain draw backs. The use of lossy material, for example, causes a loss in energy and may have an undesirable effect on the total channel length (particularly at higher frequencies where signals are quickly attenuated just by traveling along the corresponding channel). The pinning avoids this energy loss but tends to add cost and complexity to the assembly.

To help improve the performance of a connector, it has been determined that treating a pair of signals as a carefully tuned transmission channel offers the potential for substantial performance improvements without the associated issue of prior solutions. Unlike prior attempts to tune transmission channels, however, the disclosure provided herein allowed for a tuned transmission channel that functions significantly better. It should be noted that while a tuned transmission line can obviate the need for other features such as ground commoning there is still the possibility, that ground commoning could be used with a tuned transmission channel (e.g., if FEXT and/or NEXT was sufficiently problematic). Typically a tuned transmission channel will be sufficient to meet the performance goals of a connector.

Generally speaking, a receptacle that includes a housing and a cage can be provided where the receptacle is configured to provide broad-side coupled terminals. The broad-side coupled terminals are supported by separate wafers that can be combined prior to assembly to the housing or may inserted into the housing in a serial manner. The broad-side coupled terminals allow for tuned transmission channels that can, when desirably tuned, provide acceptable electrical performance at data rates of greater than 16 Gbps using NRZ encoding. Of course, the depicted embodiments can also be used in systems where data rates are less than 16 Gbps and thus the possible date rate is not intended to be limiting unless otherwise noted.

FIG. 1-10 illustrates details of embodiments that can provide tuned transmission channels on upper and lower ports. A connector system 10 includes a cage 20 that provides a plurality of upper ports 11*a* and lower ports 11*b*. The cage 20 includes a cage body 21, a cage floor 22, a cage rear 25, a cage front 23, a gasket 24 and a bezel 29 (which may be any desirable shape so long as it includes an opening that conforms to the cage front and gasket). The connector system 10 can be mounted on a circuit board 15, and can include optional inserts 26 that are positioned between ports and may also include a light pipe 28. A housing 50 is positioned in the cage 20 and supports a wafer set 60 while provide two card slots 51*a* and 51*b*.

In an embodiment, as can be appreciated, the card slots 51*a*/51*b* are each intended to interface with a single mating plug connector and each card slot 51*a* and 51*b* provide one transmit and receive transmission channel (hence providing what is typically referred to as a 1× port). As will be further discussed below, some other number of transmission channels can be provided in each port so as to provide, for example but without limitation, a 4× or 10× port.

The wafer set 60 includes a plurality of wafers, including wafer 61*a*, 61*b*, 61*c* and 61*d*. In an embodiment, 61*a* and 61*d* can be identical but for purposes of clarity are numbered separately herein. Each wafer includes a tuned channel, thus wafer 61*a* has tuned channel 62*a*, wafer 61*b* has tuned channel 62*b*, wafer 61*c* has tuned channel 62*c* and wafer 61*d* has tuned channel 62*d*. Additional tuned channels, such as tuned channel 63*b* depicted in FIG. 5, can also be provided each wafer. Thus, the number of tuned channels will depend on the desired connector configuration.

As can be appreciated, a single tuned channel is insufficient to provide a transmission channel that can operate at the desired data rates. Differential coupling is generally necessary for the transmission channel to function at the desired data rate and provide sufficient resistant to spurious noise. Thus, a transmission channel would be expected to include at least two signal tuned channels. In practice, a reference or ground terminal is typically beneficial and often it is desirable to have ground terminal on both sides of a broad-side coupled signal pair. The depicted transmission channel thus includes a ground tuned channel (62*a*), a first signal tuned channel (62*b*), a second signal tuned channel (62*c*) and a ground tuned channel (62*d*). The balanced nature of the transmission channel (e.g., the ground, signal, signal, ground configuration) has been determined to provide beneficial affects to the transmission channel performance.

Figure 5:
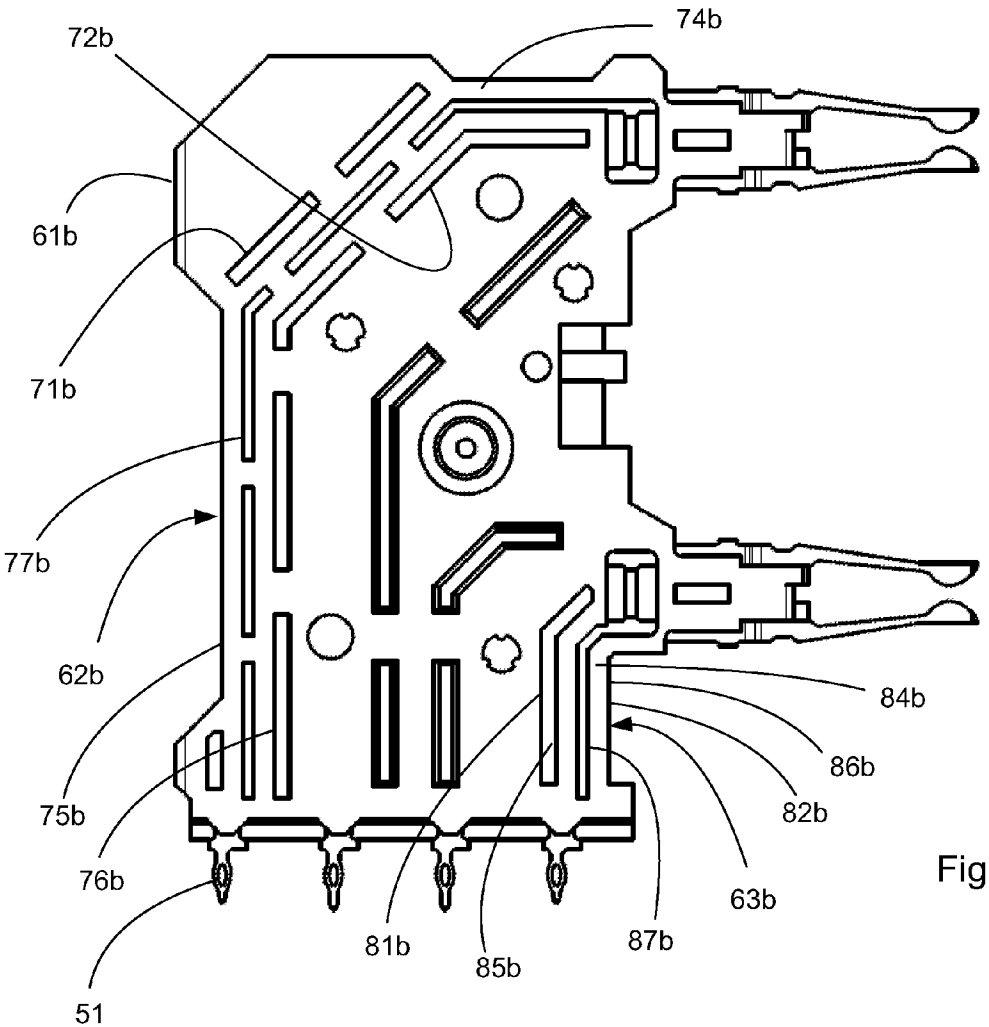
FIG. 5 illustrates an elevated side view of an embodiment of a wafer.
Figure 6:
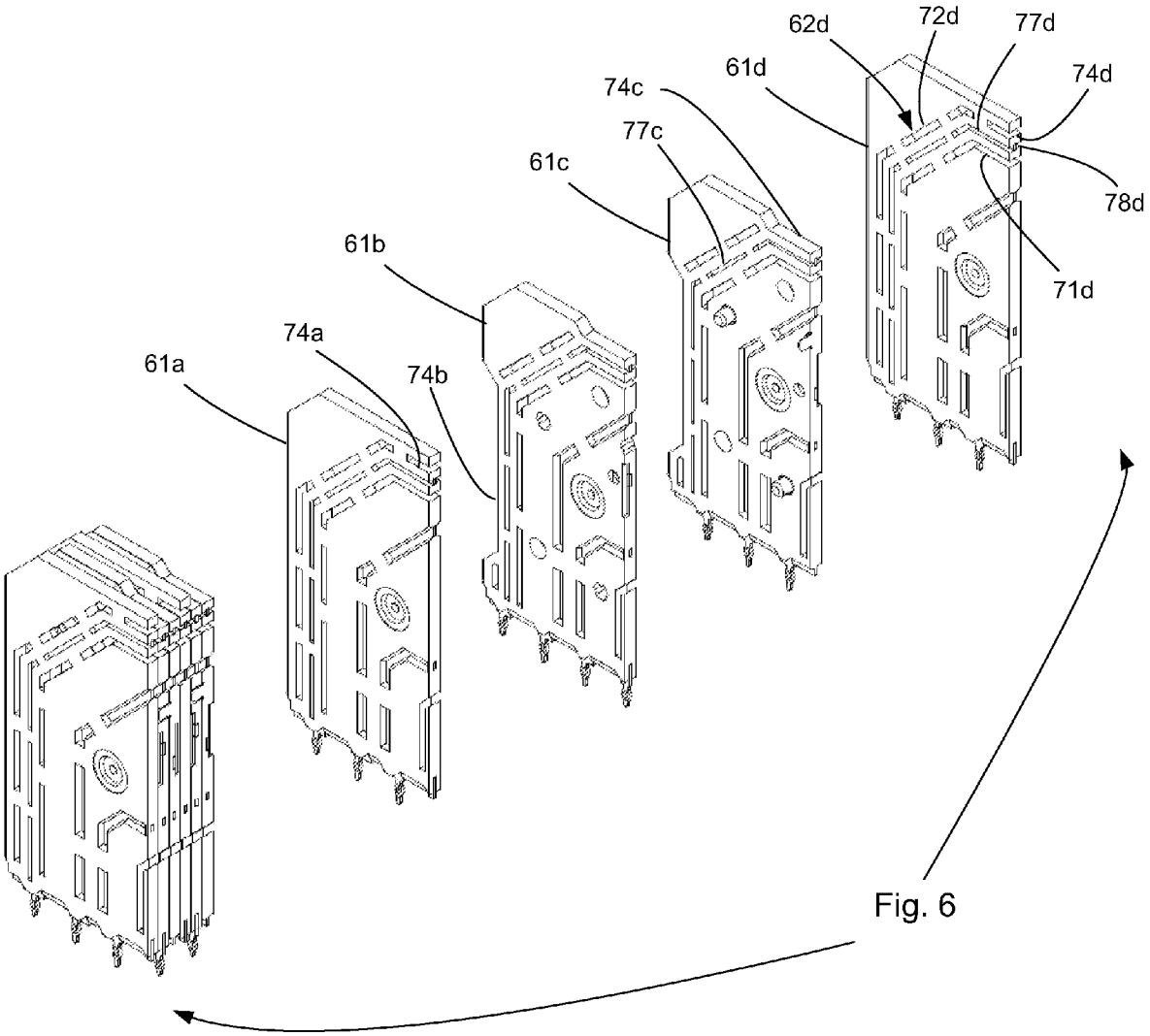
FIG. 6 illustrates an elevated front view of a cross-section of the embodiment depicted in FIG. 4, taken along line 6-6.
Figure 7:
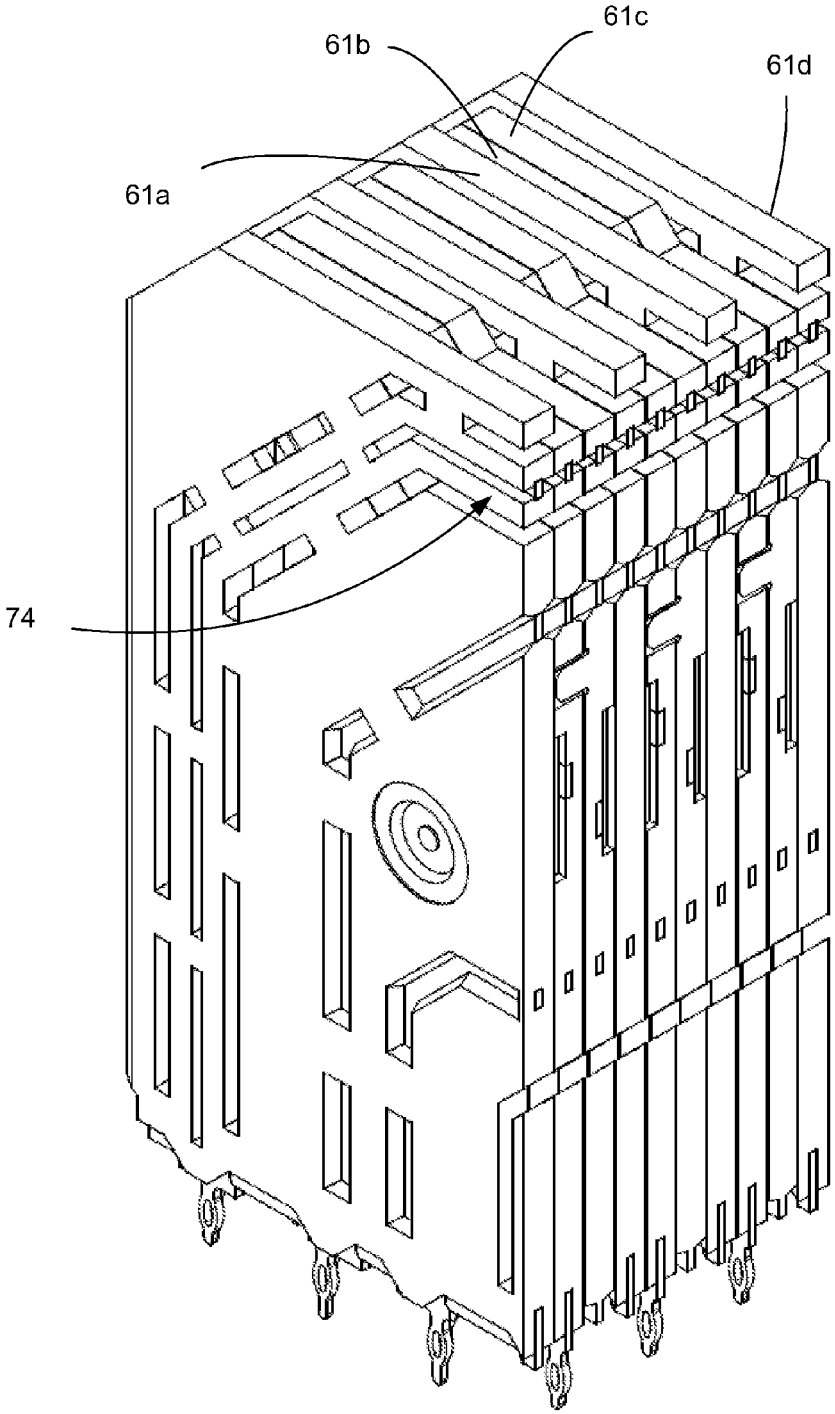
FIG. 7 illustrates a perspective view of wafer set depicted in FIG. 6.
Figure 8:
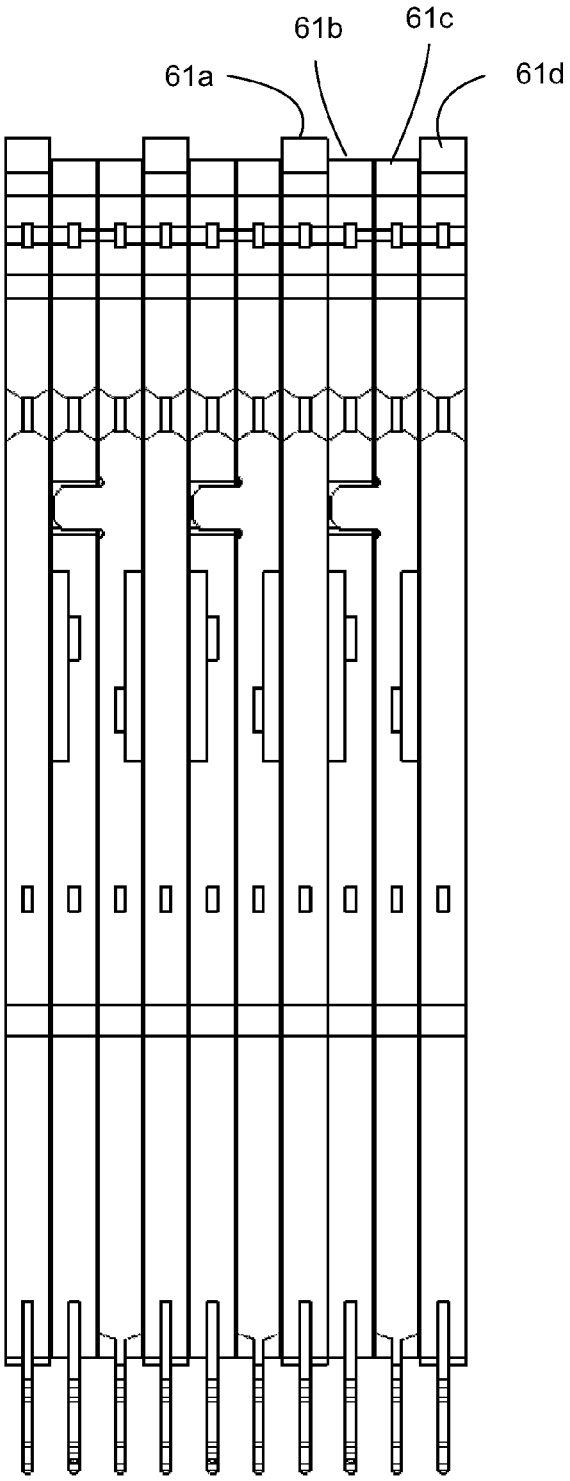
FIG. 8 illustrates an elevated front view of the embodiment depicted in FIG. 7.
Figure 9:
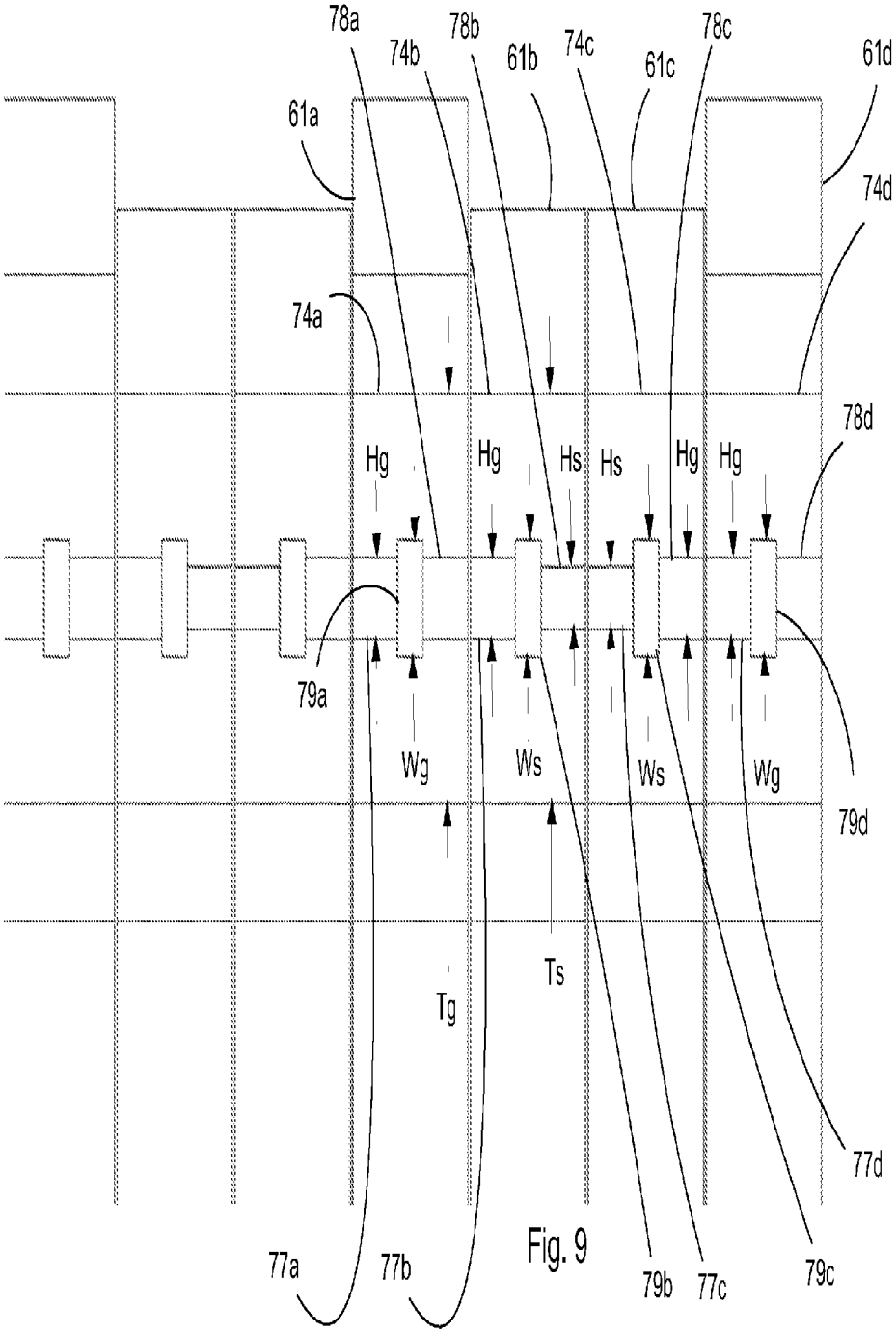
FIG. 9 illustrates an enlarged view of the embodiment depicted in FIG. 8.
Figure 10:
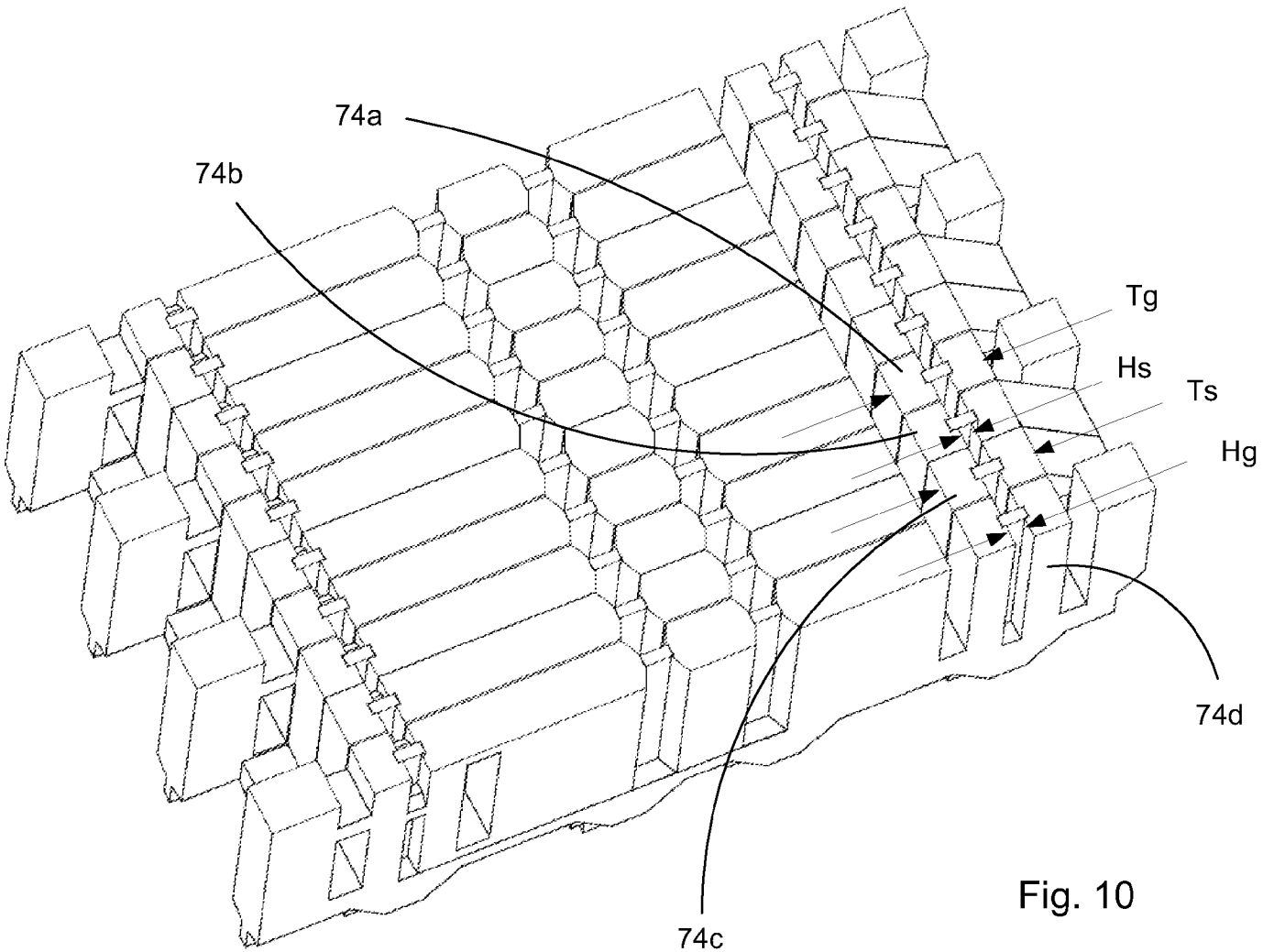
FIG. 10 illustrates a perspective view of embodiment of a wafer set.
Figure 11:
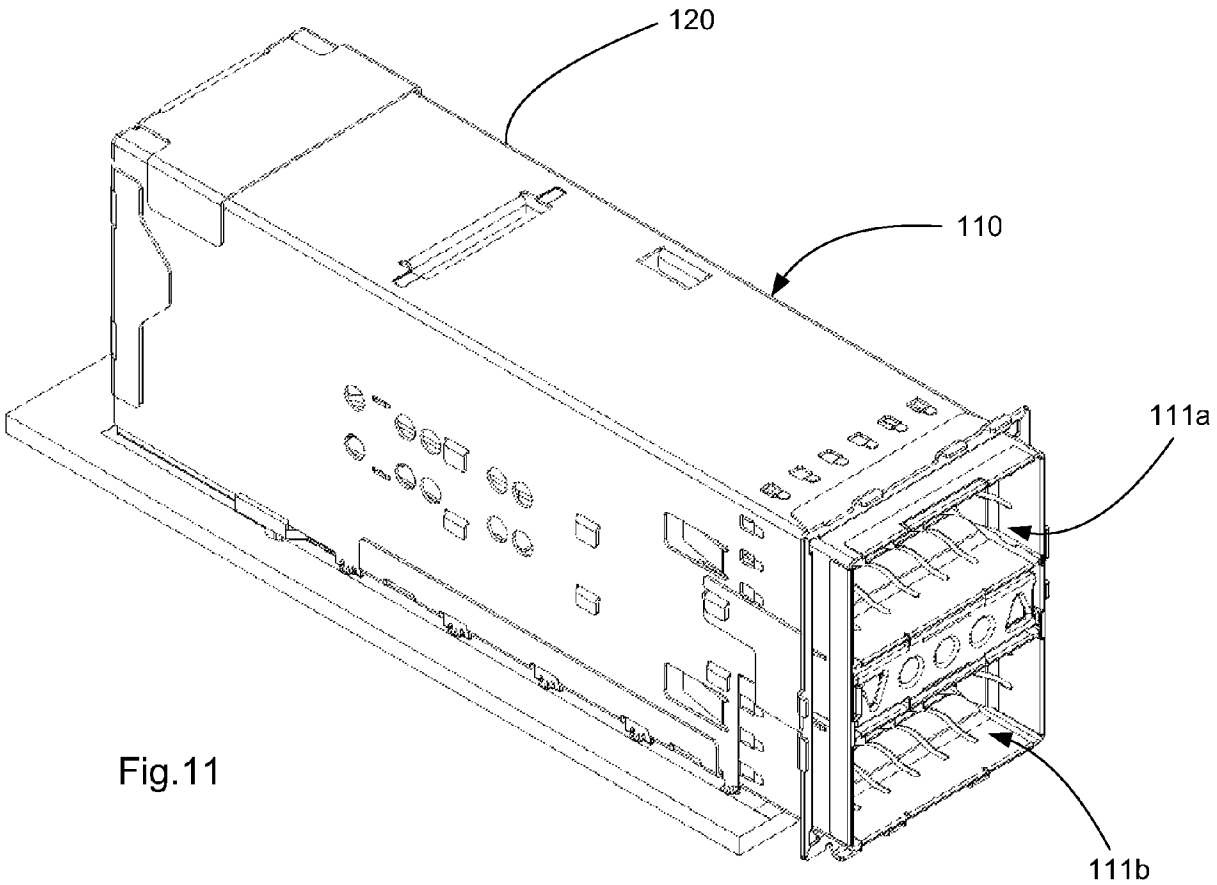
FIG. 11 illustrates a perspective view of another embodiment of an exemplary connector system.
Figure 12:
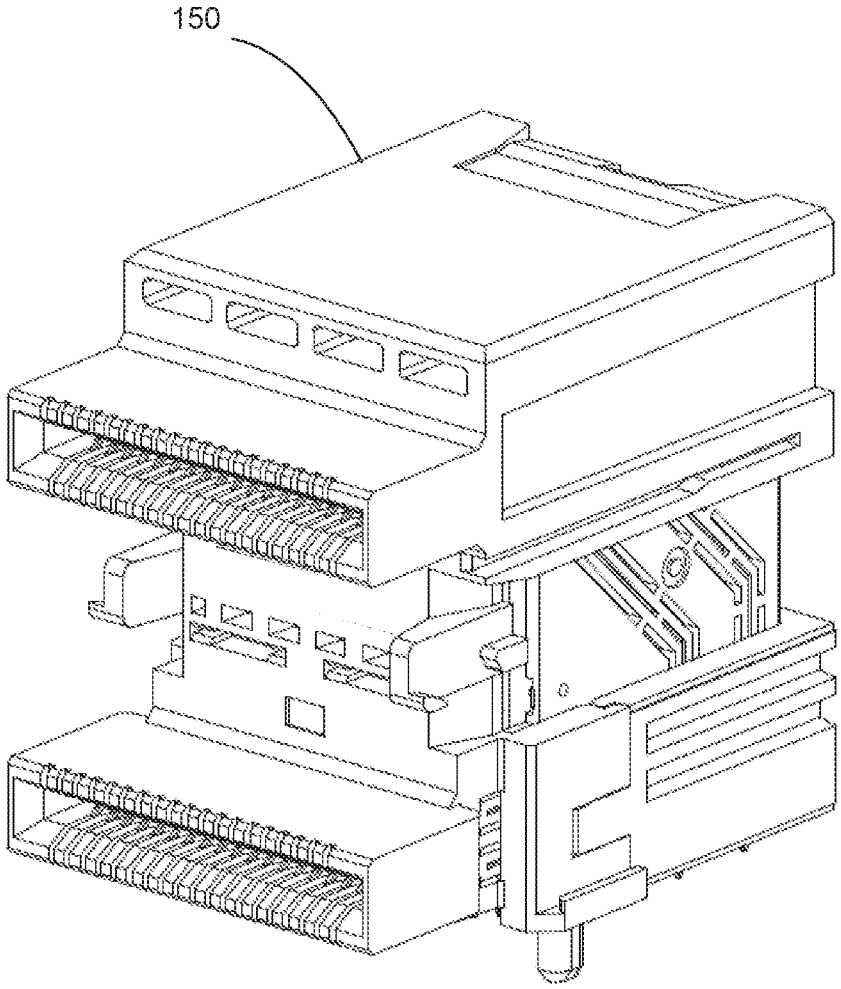
FIG. 12 illustrates a perspective view of an embodiment of a connector.
Figure 13:
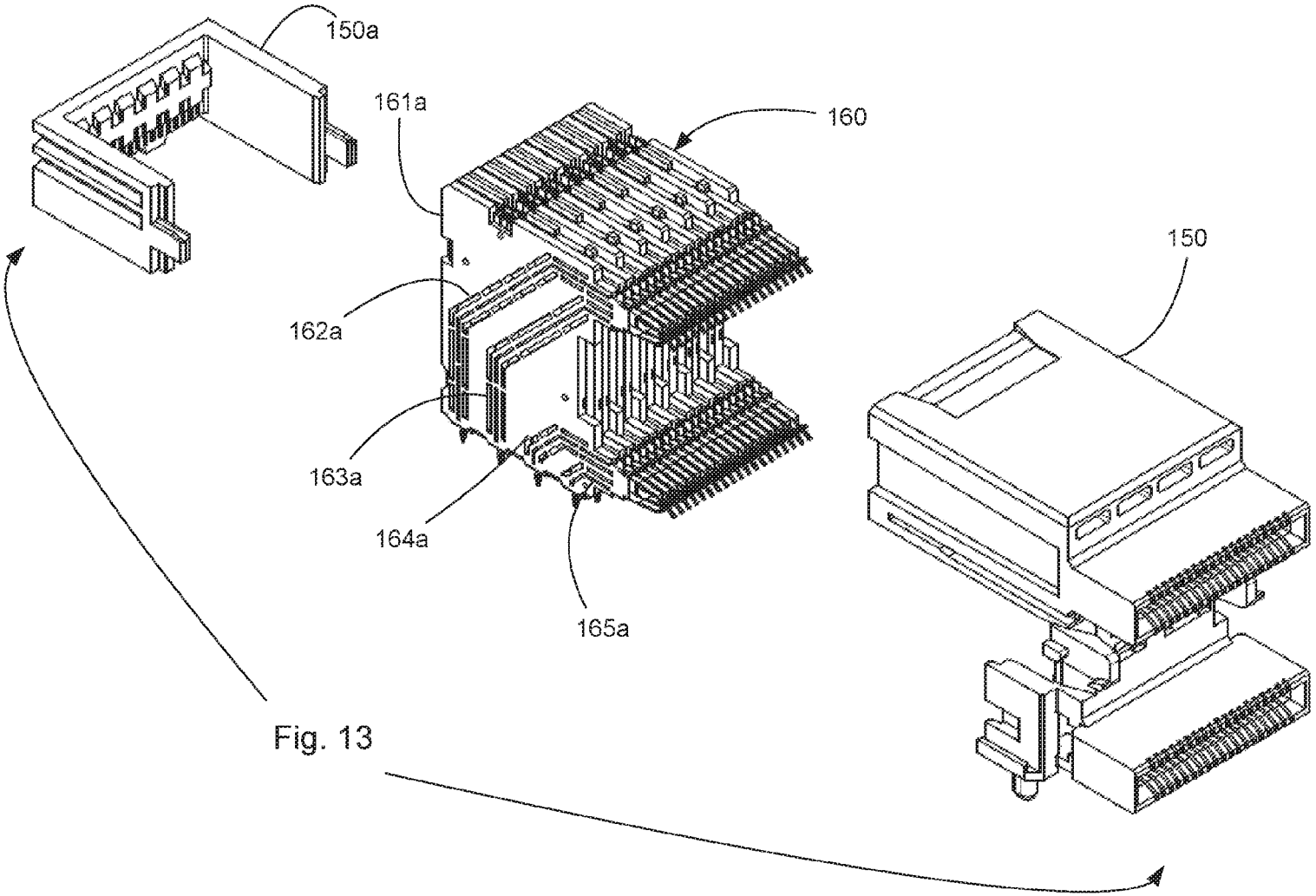
FIG. 13 illustrates a partially exploded perspective view of the connector depicted in FIG. 12.
Figure 14:
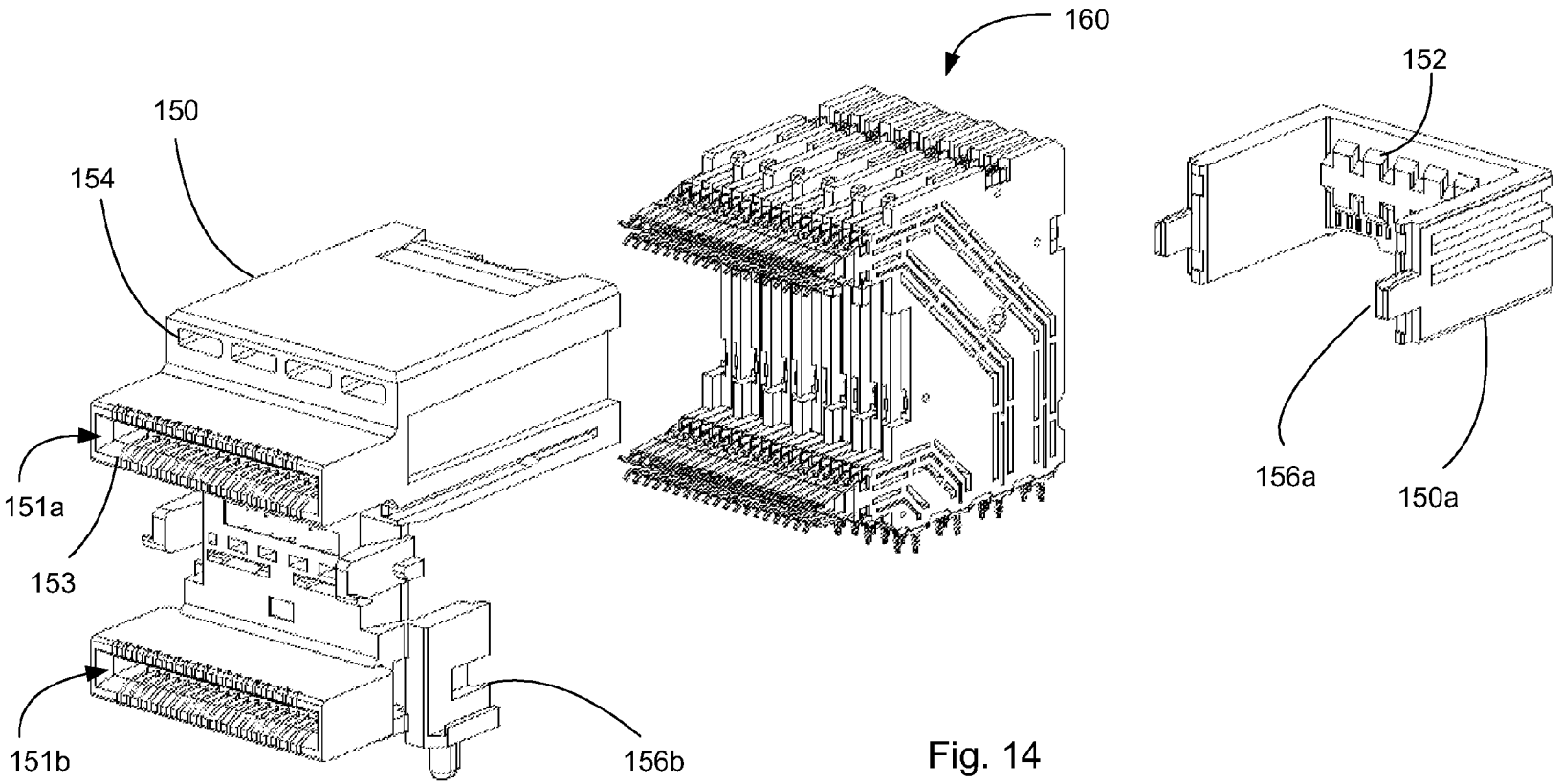
FIG. 14 illustrates another perspective view of embodiment depicted in FIG. 13.
Figure 15:
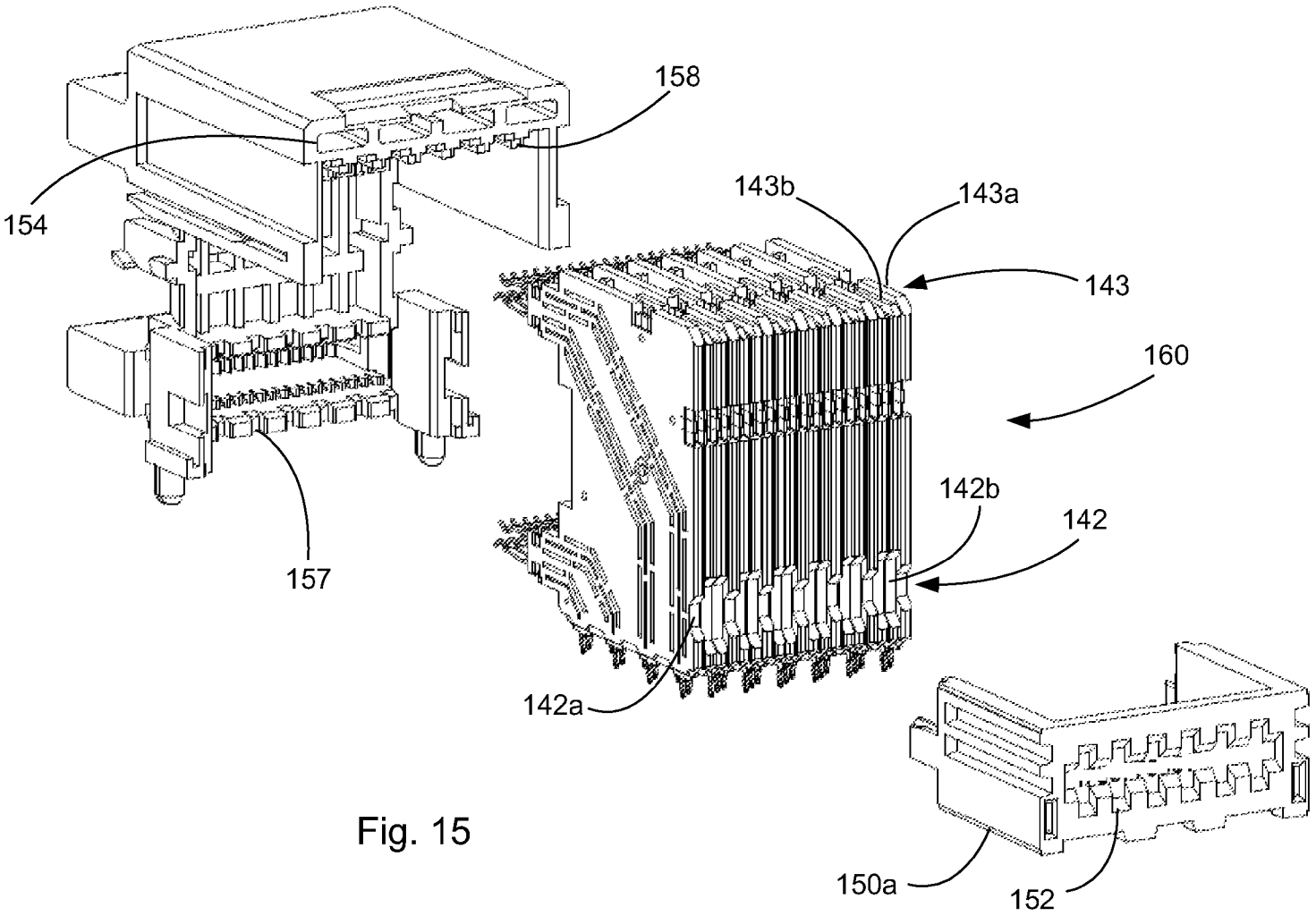
FIG. 15 illustrates another perspective view of embodiment depicted in FIG. 13.
Figure 16:
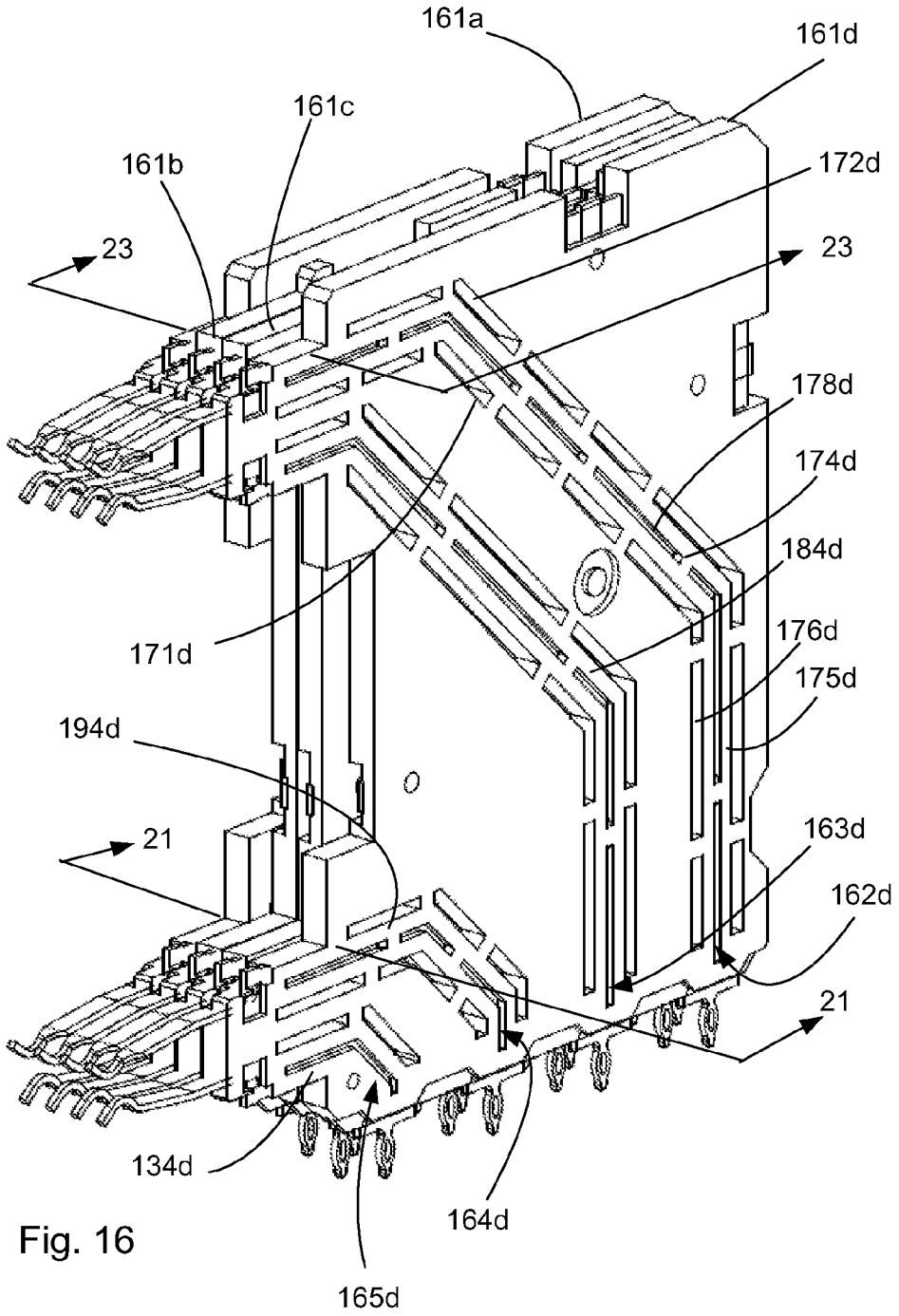
FIG. 16 illustrates a simplified perspective view of four wafers from the wafer set depicted in FIG. 13.
Figure 17:
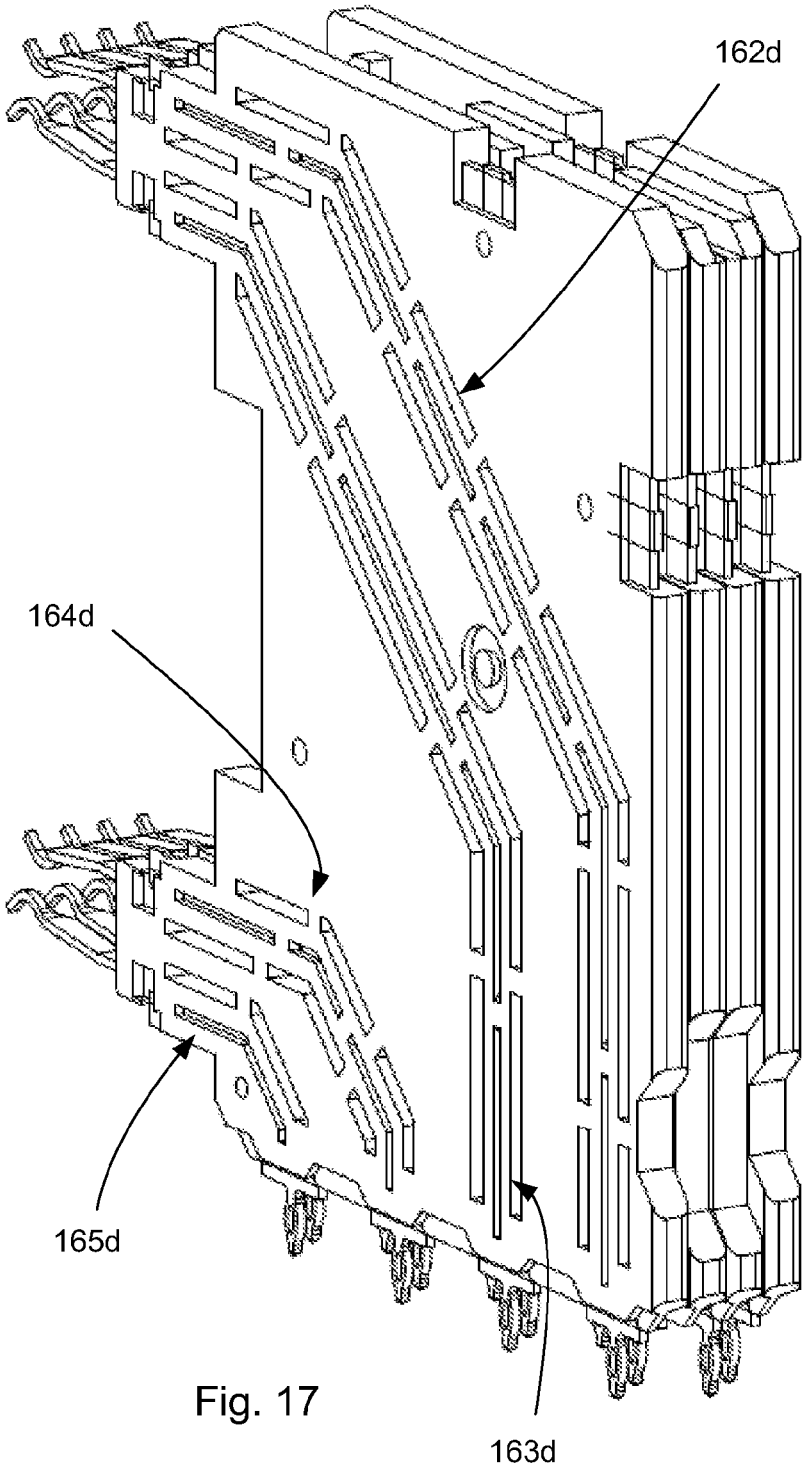
FIG. 17 illustrates another perspective view of the embodiment depicted in FIG. 16.
Figure 18:
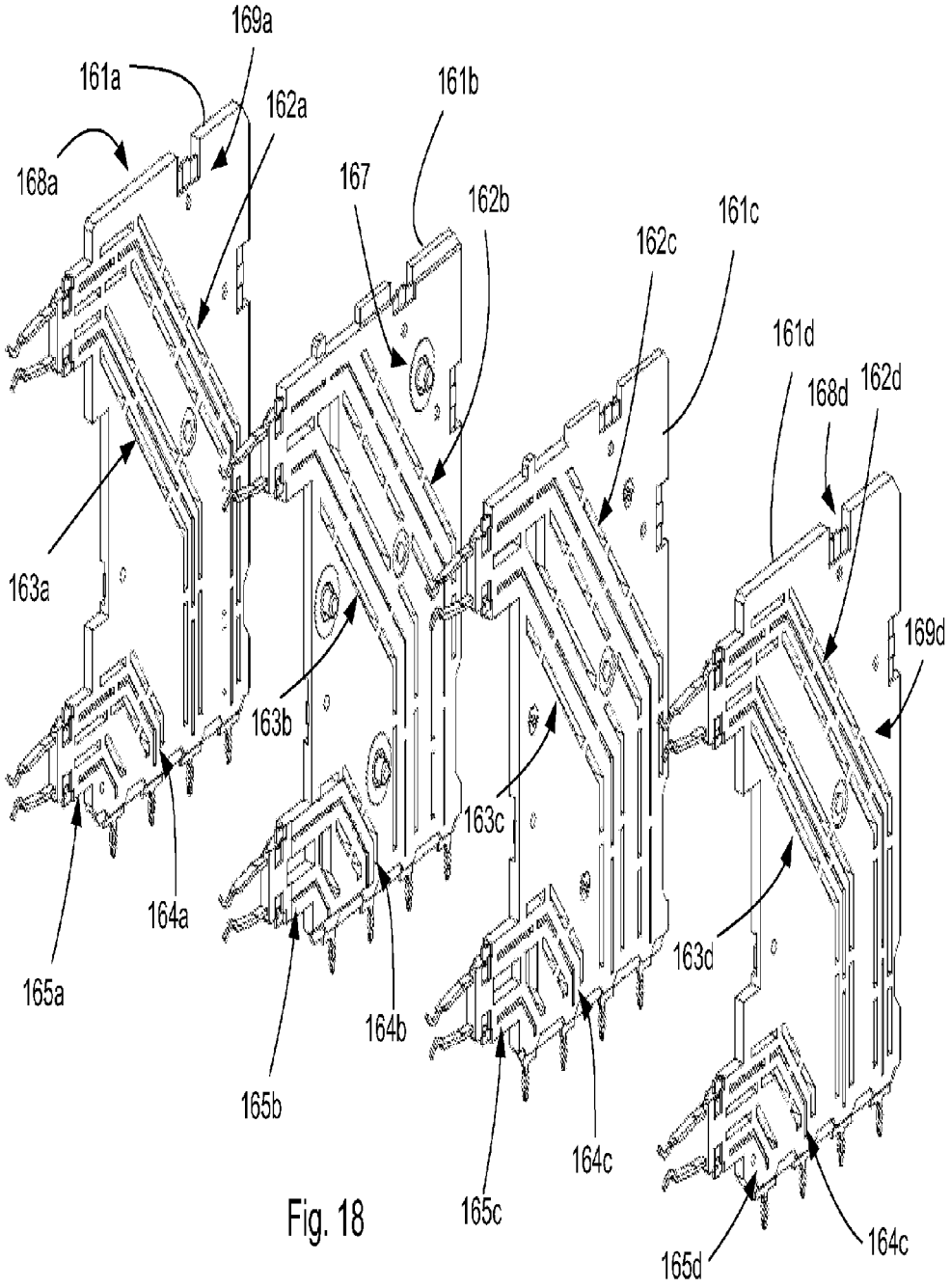
FIG. 18 illustrates an exploded perspective view of embodiment depicted in FIG. 16.
Figure 19:
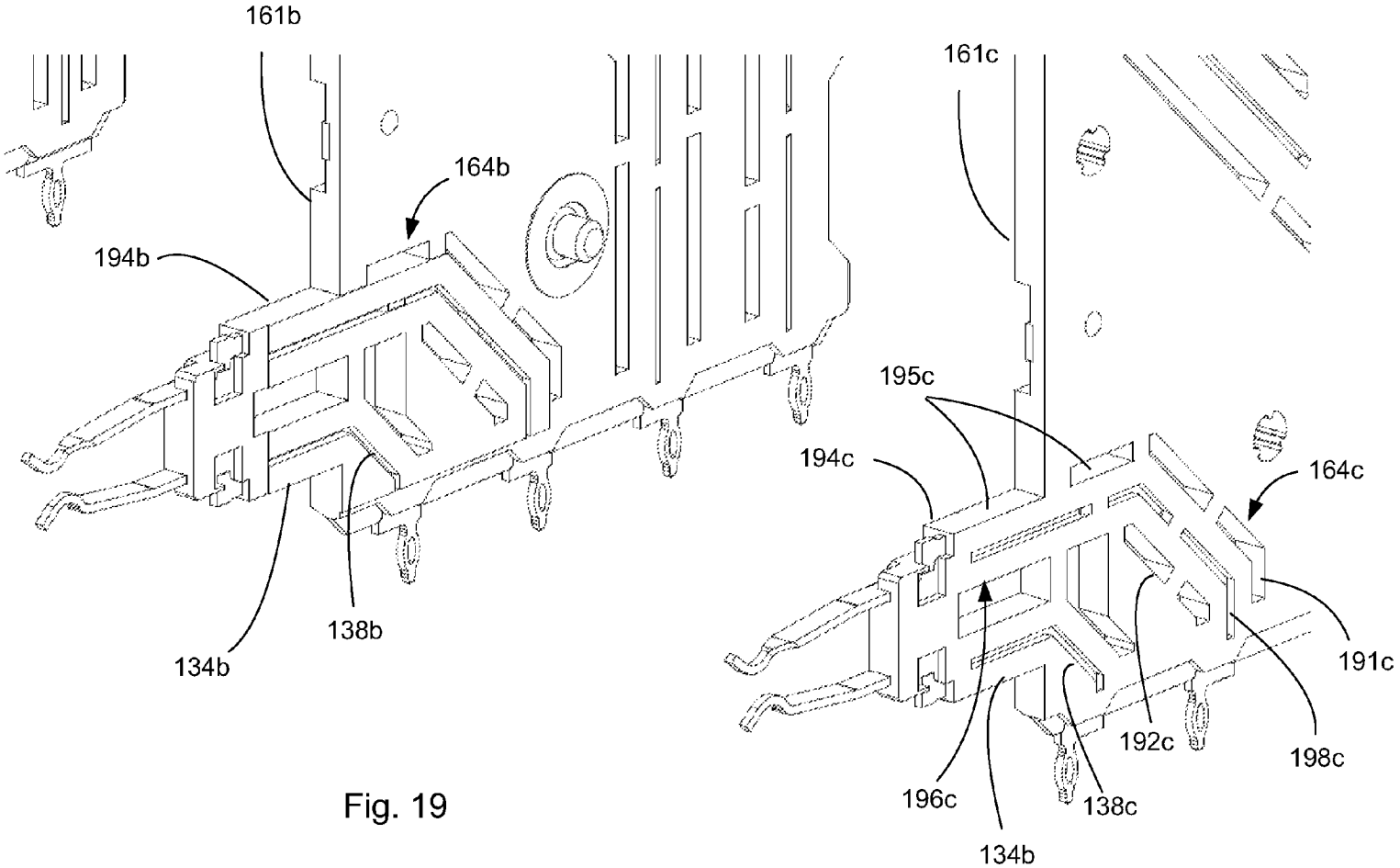
FIG. 19 illustrates an enlarged view of a portion of the wafers depicted in FIG. 19.
Figure 20:
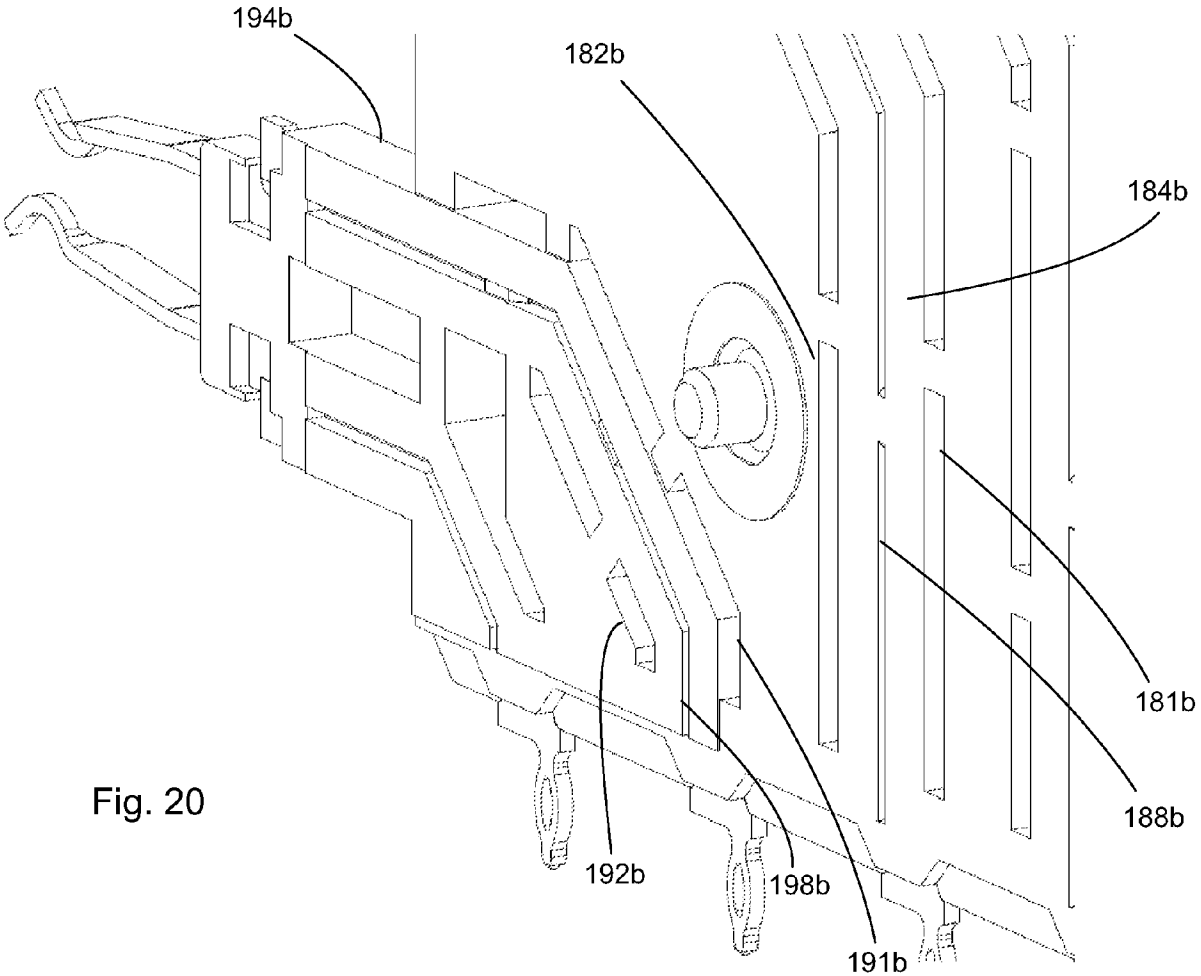
FIG. 20 illustrates another perspective view of a portion of one of the wafers depicted in FIG. 19.

FIG. 5 illustrates an elevated side view of the signal wafer 61*b* and the terminals each include tails 51. The design of the tails can be adjusted as desired and can be configured for a press-fit engagement (using an eye-of-the-needle construction as shown) or some other desired tail configuration. The tuned channel 62*b* includes a truss 74*b* that has a first edge 75*b* and a second edge 76*b*. As can be appreciated from FIG. 9-10, each truss also includes terminal grooves, such as terminal groove 77*a* and 78*a* for wafer 61*a*, terminal grooves

77*b*, 78*b* for wafer 61*b*, terminal grooves 77*c*, 78*c* for wafer 61*c* and terminal grooves 77*d*, 78*d* for wafer 61*d*.

As can be appreciated, the terminals 79*a*-79*d* are sized so Wg=Ws. This is not required (as can be appreciated from FIGS. 21-22) and in general, the equation Wg≥Ws provides acceptable performance. In addition, in certain circumstances Wg<1.5 (Ws) provides a useful limit to provide desirable performance. As can be appreciated, Tg is shown as being equal to Ts. It should be noted, however, that the equation Tg≤Ts provides suitable performance in most applications and thus it is not necessary that Ts=Tg.

It has been determined that in certain models, adjusting the height of the terminal grooves can be helpful. For example, by adjusting the height Hs and Hg so that Hg>Hs, often the performance of the tuned transmission channel can be substantially improved. In certain embodiments, further improvement is possible if Tg is at least twice Hg and preferably Tg is at least three times Hg. However, as the preferred ratio of Hg to Hs will depend on Wg, Ws, Tg and Ts (as well as their ratios and the material used for the wafer), the actual selection of the Hg to Hs ratio is within the scope of one of ordinary skill in the art and will likely require some iteration using ANSYS HSFF software, as discussed further below.

It has been found that with a three wafer system, it is possible to provide a repeating ground, signal, signal patter that provides for Hg>Hs. It should be noted that the depicted embodiment functions along the top and bottom row of terminals. Naturally, with sufficient vertical space the middle two rows of terminals could also provide the tuned transmission channels. However, for applications (such as SFP style applications) that only require a two differential signal pair (one TX and one RX channel), the depicted embodiment allows for a first and second SFP cable to be mated to the connector while providing high data rates for both (it being understood that one of the plugs would be turned upside down in the depicted and optional configuration).

FIGS. 11-24 illustrate an embodiment of a connector 110 that includes a cage 120 with port 111*a* having a card slot 151*a* and port 111*b* having card slot 151*b*. A housing 150 is positioned in the cage 120 and the housing 150 supports a wafer set 160. As depicted, the housing includes a housing support 150*a* that helps secure the wafer set 160 in position. In addition, as the wafer set 160 includes three separate wafers, the rear support 150 includes a projection profile 152 that is matched with recess profile 142 (which as depicted is formed by recesses 142*a* and 142*b*). The housing 150 includes shoulder profile 158 that engages top profile 143 so as to help ensure the wafer set 160 is appropriately inserted into the housing 150. Specifically, top wafer profile 143*a* (which is part of a ground wafer) is different than top wafer profile 143*b* (which is part of a signal wafer) and thus helps ensure the top profile 143 is aligned with the shoulder profile 158. Additional variations in the profiles can be used if desired. The benefit of these mating/match profiles is improved control of the position of the wafer set 160 with respect to the housing 150. In addition, the profiles can provide an additional check that ensures the proper wafer configuration is being used (e.g., only the appropriate pattern of ground and signal wafers can be assembled).

As depicted, the wafer set 160 includes with a signal wafer 161*c* depicted on an end of the wafer set, it being understood that a ground wafer 161*a* could also be provided on the end of the wafer set 160. Each wafer can provide tuned channels to provide for improved signal performance. Each tuned channel includes a terminal (such as terminal 199*a*-199*d*) with a body that extends from a contact to a tail, as is conventional in wafer construction.

In an embodiment of a three wafer system, the wafers can be arranged in a ground wafer 161*a*, a signal wafer 161*b*, a signal wafer 161*c* and ground wafer 161*d* pattern (with the understanding that the wafers will be configured to provide a repeating pattern that effectively provides for two signal wafers surrounded on both sides by a ground wafer or an extra ground wafer on the end). Of course, some other number of wafers can be used if desired.

The depicted pattern includes tuned channel 162*a* in the ground wafers 161*a*, tuned channels 162*b* in wafer 161*b*, tuned channel 162*c* in wafer 161*c* and tuned channel 162*d* in wafer 161*d*. Thus, four tuned channels are provided in a row from left to right, 162*a*, 162*b*, 162*c*, 162*d* and form a tuned transmission channel. It should be noted that dimensions of the truss that surrounding the signal terminals can be different than the dimensions of the truss that surrounds the ground terminals. However, such a tuning is not required in all cases, as will be further discussed below. The benefit of having different dimension for the truss and terminals on the ground and signal pairs is that it is sometimes easier to find a desired configuration that appropriately tunes the simplified channel in ANSYS HSFF software (as will be discussed below).

As depicted, Hg>Hs and Wg>Ws. The use of the larger terminal bodies helps provide shielding between adjacent tuned transmission channels (and potentially reduce cross talk). The use of the smaller terminal grooves between the two terminals is believed to help focus the energy between the two signal terminals (air being a medium which has lower loss than the plastic formed by the wafer), thus also helping to reduce cross talk. In certain embodiments, the ratio of sizes can range between Hg=1.1 (Hs) to about Hg=1.4 (Hs). It should be noted that the selection of Hg will somewhat depend on the desired impedance and the width of the size of the terminals, along with the thickness Tg, Ts of the respective truss. If Hg is small enough, it becomes difficult to set Hs smaller than Hg and enable a reliable manufacturing process. In such circumstances, Hs can be set to zero. However, if Hs is greater than zero, then it is preferable to have Hg<1.5 Hs. And, as can be appreciated from the below discussion, it is also possible to have Hg=Hs, assuming other factors are appropriately sized.

As can be appreciated from the above discussion, assuming the same terminal thickness is used, it is possible to vary the width of the terminals, the height of the air grooves provided on both sides of the terminal (assuming that an air groove is provided) as well as the thickness of the truss. The combination of these factors allows the performance of a resultant communication channel provided by the two signal terminals functioning as a differential signal pair with greater performance than would be possible if the setting were kept constant for each wafer (e.g., if the channel provided around each terminal body was not tuned).

As can be appreciated, in certain embodiments only one row of terminals per card slot is configured with the truss. In other embodiments, both the upper and lower row of terminals may include the trusses and may also include air channels that are configured to provide suitable performance.

In certain embodiments the terminals associated with an upper card slot are substantially longer than the terminals that are associated with a lower card slot, such as is depicted in FIGS. 11-24. As can be appreciated, a connector 110 is disclosed as having a cage 120 that provides upper port 111*a* and lower port 111*b*. The connector 110 includes a housing 150 positioned in the cage 120 and the housing 150 includes a first and second card slot 151*a*, 151*b* aligned with the ports 111*a*, 111*b*, respectively, and the housing 150, in conjunction with rear support 150*a*, supports a wafer set 160. For improved air flow, the housing includes air channels 154 that extend from the front face to the rear face of the housing and advantageously both provide structural support and improved air flow when a module is not inserted into the corresponding port, along with the tuned channels 162*a*, 182*a*, 192*a*, 132*a* in wafer 161*a* that is supported by housing 150 and rear support 150*a*.

The wafer set 160 includes a first wafer 161*a*, a second wafer 161*b*, a third wafer 161*c* and a fourth wafer 161*d*. As depicted, the first and fourth wafer are configured the same while the second and third wafer are configured differently. Thus, the depicted system can be considered a repeating three wafer system. By aligning the wafers in a ground-signal-signal repeating pattern, a ground, signal, signal, ground structure is provided for each pair of signal wafers (which may be joined together before being inserted into the housing) and provides a tuned transmission channel. This allows for a row of contacts where each tuned transmission channel is configured to be suitable for applications that require a high data rate in and each differential pair is separated by a ground terminal.

As depicted, each wafer 161*a*-161*d* has four tuned channels, with wafer 161*a* having tuned channels 162*a*, 163*a*, 164*a*, and 165*a* while wafer 161*b* has tuned channels 162*b*, 163*b*, 164*b*, 165*b*. Similarly, wafer 161*c* has tuned channels 162*c*, 163*c*, 164*c* and 165*c*. Wafer 161*d* (which is a repeat of wafer 161*a*) has tuned channels 162*d*, 163*d*, 164*d* and 165*d*. Each depicted wafer has a terminal groove aligned with the terminal and includes a truss to support the terminal (such as truss 174*a*-174*d* used to support the uppermost terminal in wafers 161*a*-161*d*, respectively). Thus, depicted wafer 161*d* also includes truss 184*d*, 194*d* and 134*d* while wafer 161*c* would include includes truss 194*c* and 134*c* for the lower card slot 151*b* and wafer 161*b* includes truss 184*b*, 194*b* and 134*b*. Each truss has a thickness, which can be generally referred to as T and the signal terminals can have trusses that are the same thickness so that they provide a balanced communication channel. Thus, truss 194*b* and 144*c* have a thickness Ts that is the same. However, as depicted, truss 194*a* and 194*d* (which are trusses that support ground terminals) have a thickness Tg that is greater than Ts. As can be appreciated, the truss thickness can be defined by a plurality of features. For example, as noted above, the truss thickness can be defined by slots and/or edges of the wafer. Naturally, the truss thickness can be defined by any desired combination of grooves, edges and apertures. In that regard, tuned channels near an edge of a wafer are well suited to being partially defined by a wafer edge while tuned channels that traverse some distance from the edge are better suited to be defined by a combination of grooves and/or apertures.

FIGS. 21-24 illustrate details of tuned transmission channels that can be used to provide desirable performance in a stacked configuration (such as the two card slots depicted in FIG. 12 that are intended for use in two ports) that is configured to provide high data rates in both upper and lower ports. Such a configuration could also be used for connector configurations that provide stacked card slots for each port (such as is provided in the CXP style connector defined by an INFINIBAND specification or miniSAS HD style connector defined by the SAS/SATA specification).

As mentioned above, the wafers can be configured to provide terminals 199*a*-199*d* in a ground, signal, signal, ground pattern that provides ground terminal 199*a*, 199*d* with a width Wg, two signal terminals 199*b*, 199*c* with a width Ws. The terminal grooves have a height Hs between the signal terminals and a height Hg between ground and signal terminals. As depicted, the terminal groove between the signals has a height Hs that is less than a height Hg between both a signal/ground and a ground/ground combination. Thus, the signal wafers have terminal grooves with two different heights and the height of the terminal groove on the side adjacent another signal wafer is less than the height of the terminal groove facing in the opposite direction.

To further enhance electrical performance, trusses supporting the signal terminal body have a thickness Ts that is greater than a thickness Tg of the trusses supporting the ground terminals. However, a width Wg of the ground terminal body is greater than a width Ws of the signal terminal body. Thus, as depicted the ground terminals 199*a*, 199*d* are wider while the ground trusses are less thick. As noted above, the desired combination of ranges for each value will depend on the materials selected and the performance desired and the pitch of the terminals.

With respect to the potential range of applications, one possible application can have a pitch of 0.75 mm. Convention high data rate IO connectors (such as SFP or QSFP connectors) typically have a 0.8 mm pitch. A pitch of 0.75 mm, while very similar to a pitch of 0.8 mm, has been determined to be much more sensitive to variations in manufacturing and tuning the performance is substantially more challenging. One potential method of addressing the performance needs is to use an offset construction. For example, as can be appreciated for FIG. 22, the signal terminals are offset because distance D1 is not equal to distance D2. While this can be compensated by have a deeper air groove on one side than the other, it has been determined that the resulting configuration can provide an unbalanced tuned channel because the dielectric material surrounding the signal pair is not the same. This potentially cause the signal pair to form an unintentional mode with one ground terminal that is stronger than an unintentional mode with the other ground terminal, which can result in higher levels of crosstalk. One potential solution that has been found helpful, particularly if the pitch is at 0.75 mm, is to provide an optional notch N (shown in broken line) so that centerline C1, which extends in the middle between the two signal terminal but is offset from the wafer edge, has substantially the same cross-sectional area of dielectric material on both sides.

As can be appreciated, edge 169*a* and edge 168*b* are configured between truss 194*a* and truss 194*b* so that a space exists between them. In contrast, edge 169*b* of wafer 161*b* and edge 168*c* of wafer 161*c* at the truss 194*b* and 194*c*, respectively, are positioned so that they are flush. While not required, it has been determined that positioning the signal wafers so that they are flush against each other tends to provide a better performing tuned channel when the channel is shorter (such as the channel(s) that support a lower port of a stacked connector) because it helps provides some additional levels of dampening.

Somewhat surprisingly, however, it has been determined that in certain embodiments the tuned transmission channels for the upper port provide better performance when the wafers are slightly spaced apart (e.g., there is a wafer-to-wafer between the signal wafers). For example, the tuned transmission channel depicted in FIG. 24 illustrates trusses 174*a*-174*d* have trusses with a thickness defined by surfaces 175*a*-175*d* and surfaces 176*a*-176*d* so that the trusses have a configuration that are similar to that depicted in FIG. 22. The trusses also support terminals that have terminal widths Wg' and Ws' to the terminal widths Wg and Ws of FIGS. 21-22. In addition, the terminal grooves such as 177*a*-177*d* and 178*a*-178*d* are configured with heights with Hg' and Hs' that vary similarly to the heights of the terminal grooves depicted in FIG. 22. However, unlike the transmission channel in FIGS. 21-22, the transmission channel in FIG. 23-24 has a space between the edges of the signal wafers. Or to put it another way, the edge 169*a* and 168*c* are configured so that a space is provided between the trusses 174*b*, 174*c* while omitting the space between trusses 194*b* and 194*c*.

Figure 21:
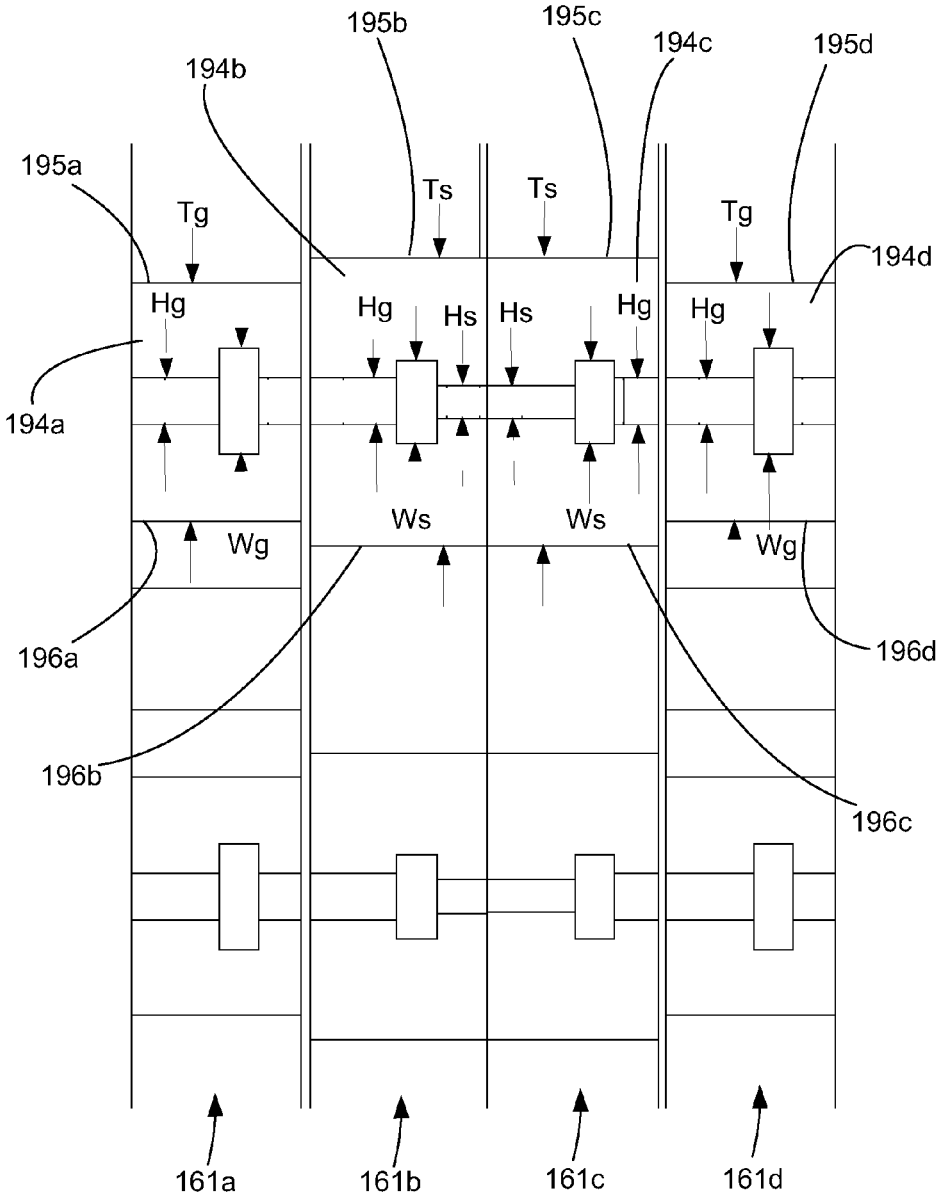
FIG. 21 illustrates a view of an elevated front view of a cross-section of the embodiment depicted in FIG. 16, taken along line 21-21.
Figure 22:
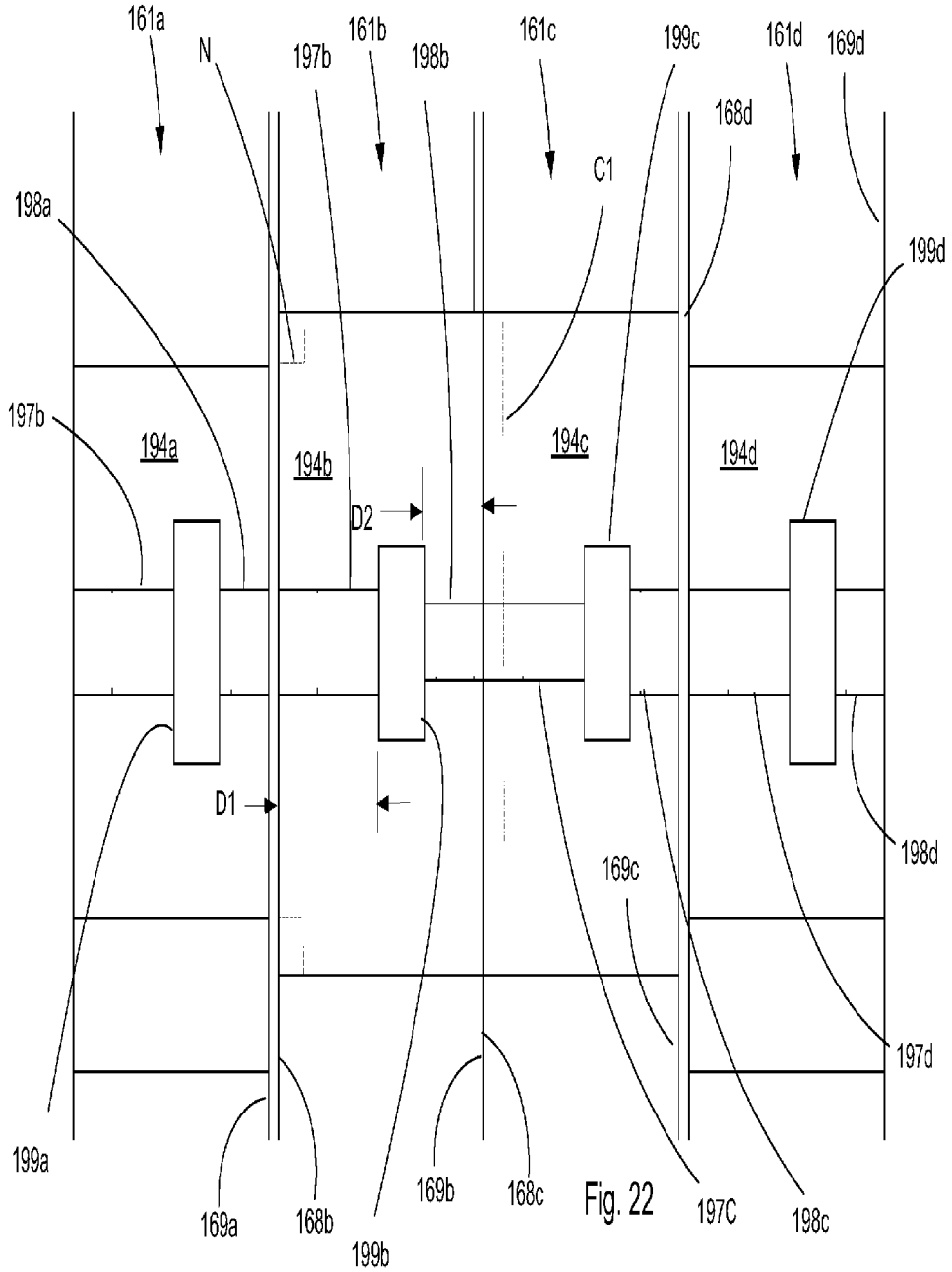
FIG. 22 illustrates an enlarged view of the embodiment depicted in FIG. 21.
Figure 23:
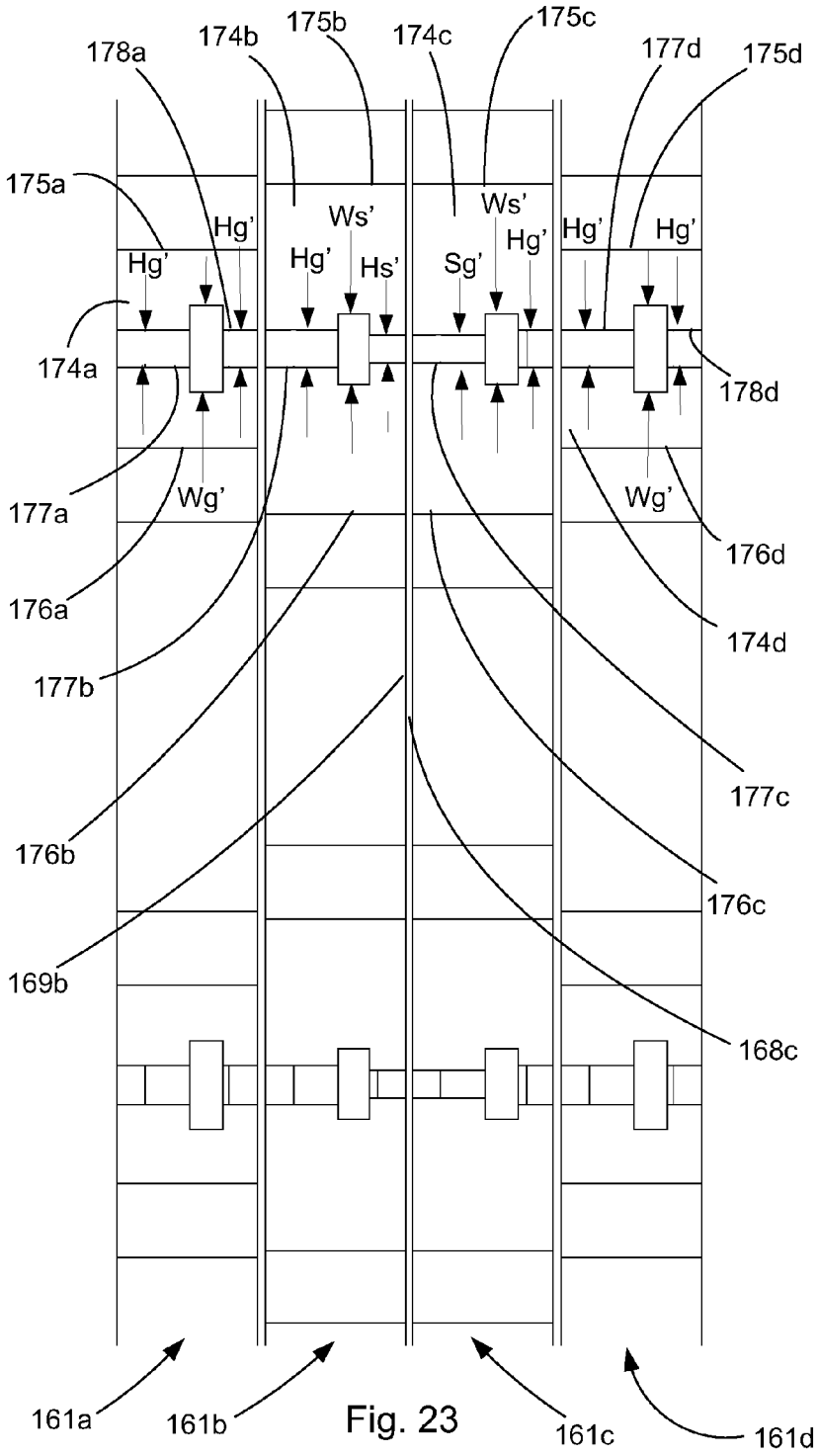
FIG. 23 illustrates a view of an elevated front view of a cross-section of the embodiment depicted in FIG. 16, taken along line 23-23.
Figure 24:
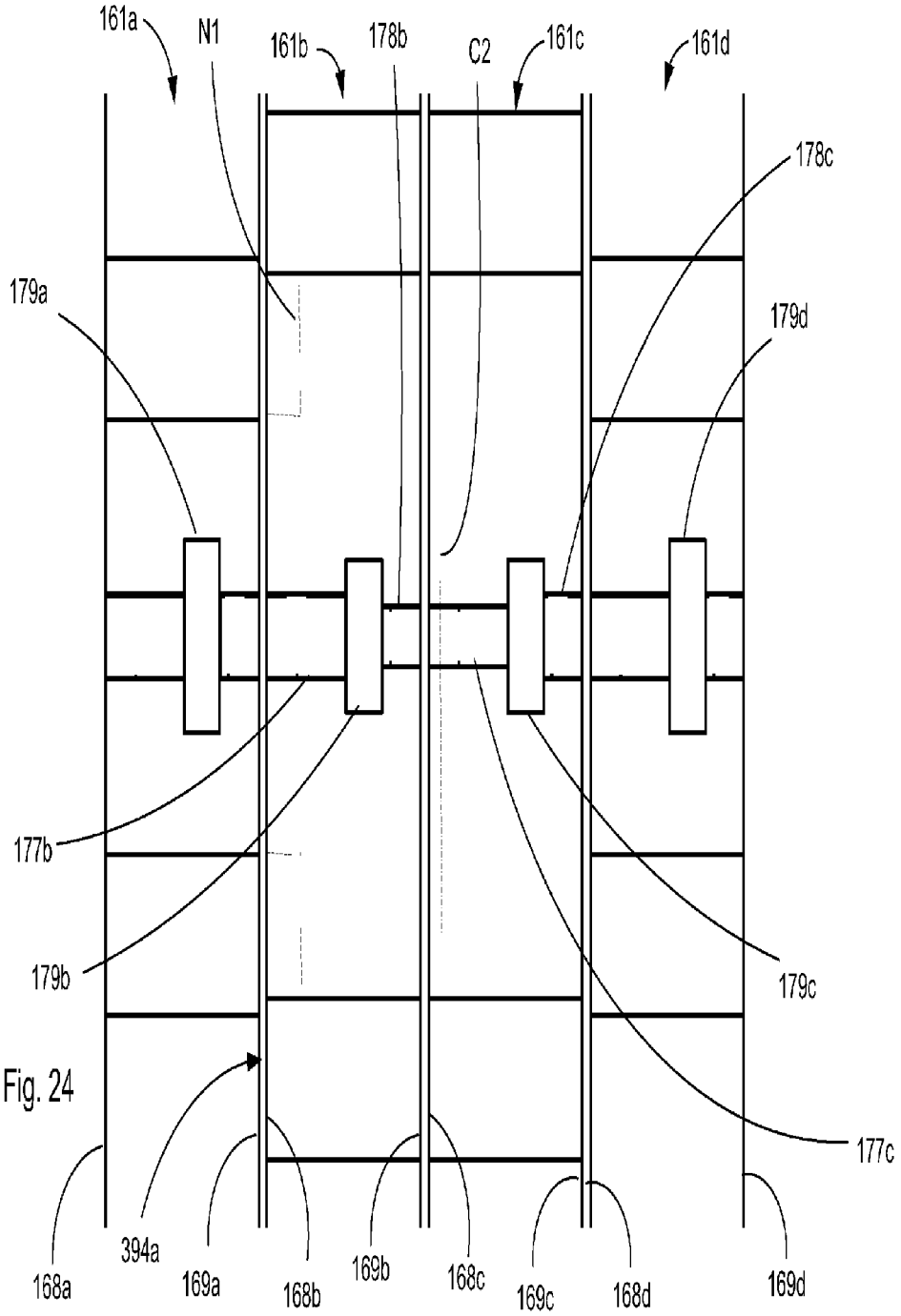
FIG. 24 illustrates an enlarged view of the embodiment depicted in FIG. 23.
Figure 25:
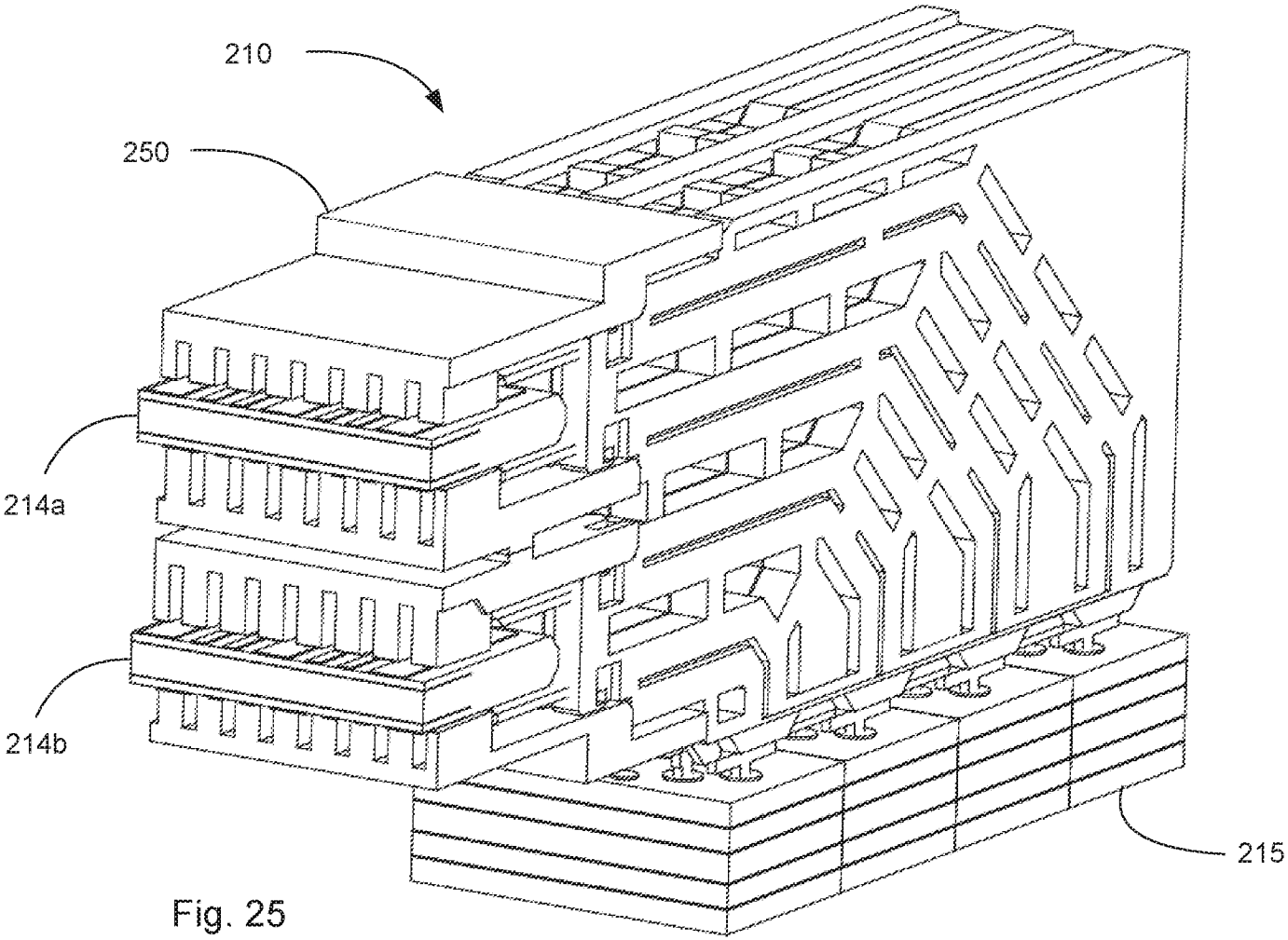
FIG. 25 illustrates a perspective view of another embodiment of an exemplary connector system.
Figure 26:
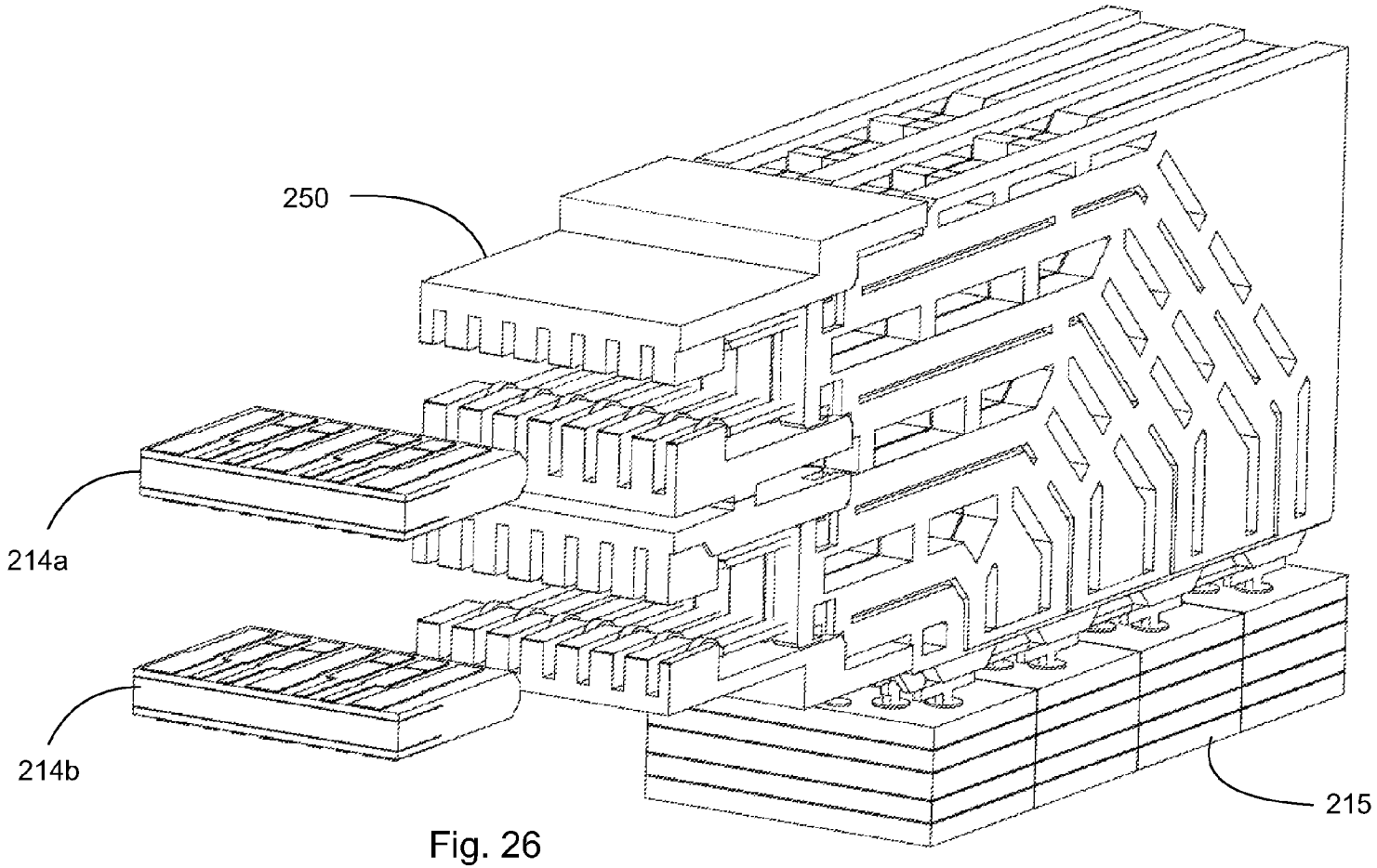
FIG. 26 illustrates a partially exploded perspective view of the embodiment depicted in FIG. 25.
Figure 28:
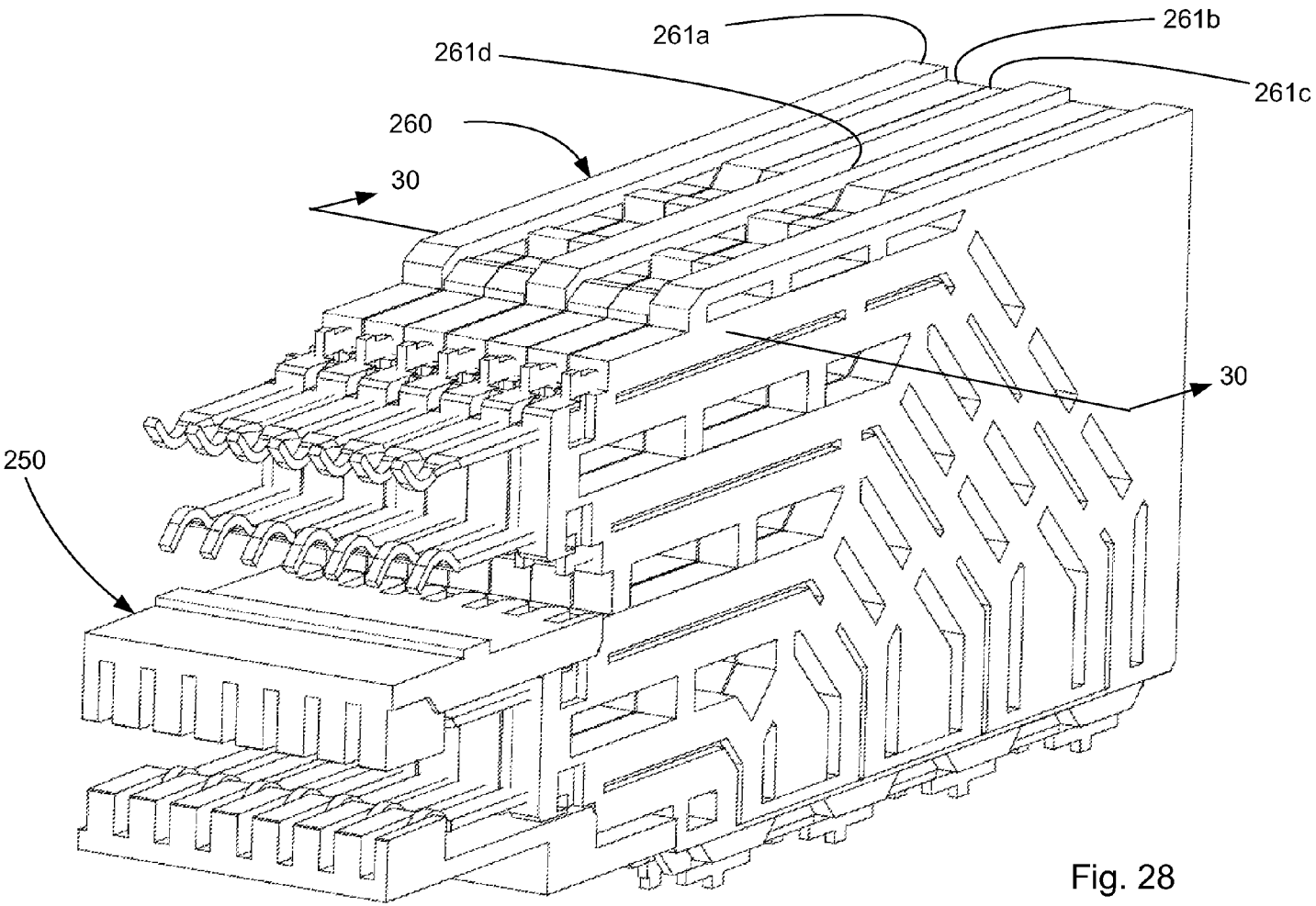
FIG. 28 illustrates a perspective simplified view of the connector depicted in FIG. 27.
Figure 29:
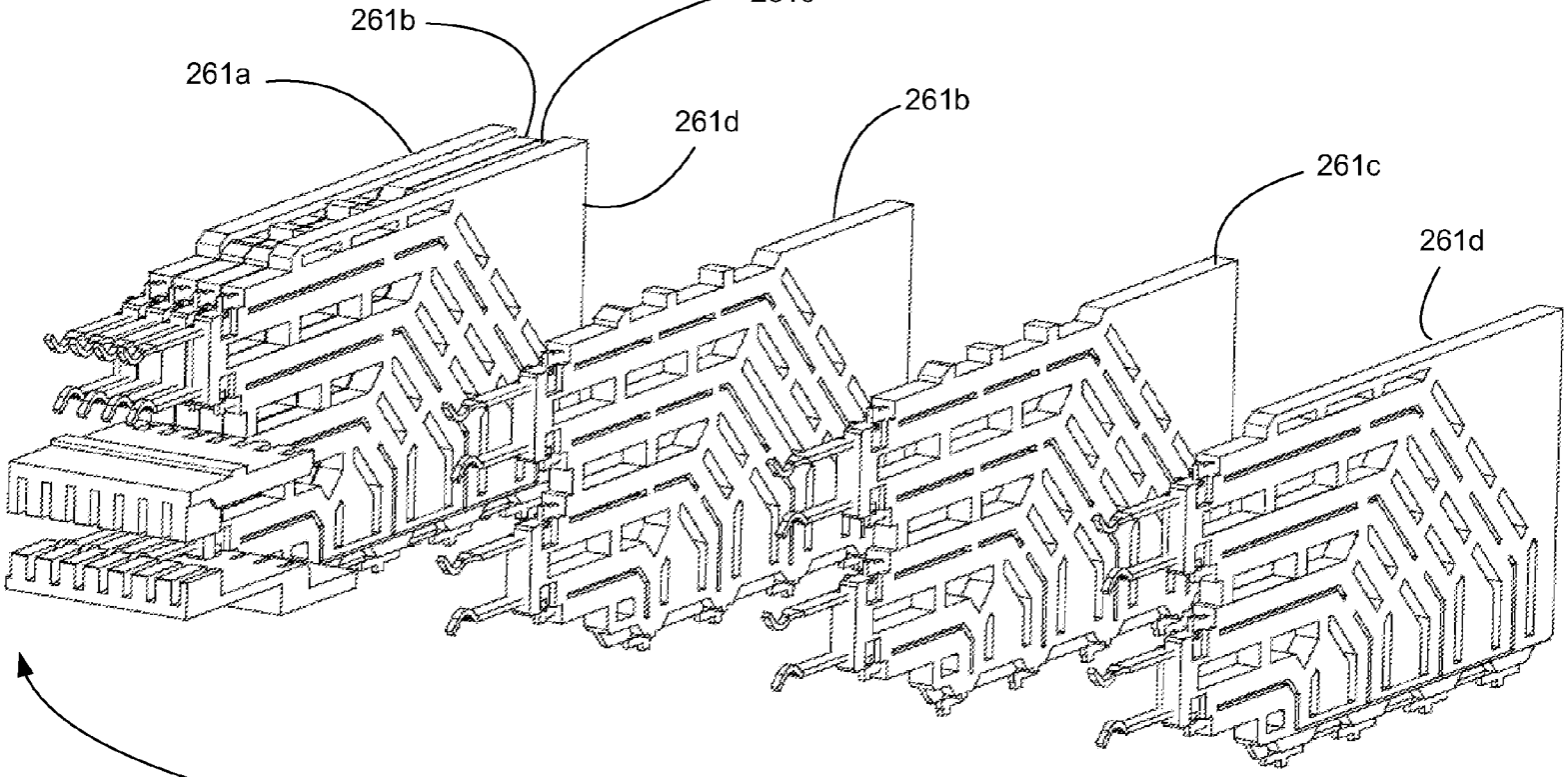
FIG. 29 illustrates a partially exploded perspective view of the embodiment depicted in Fig.
Figure 30:
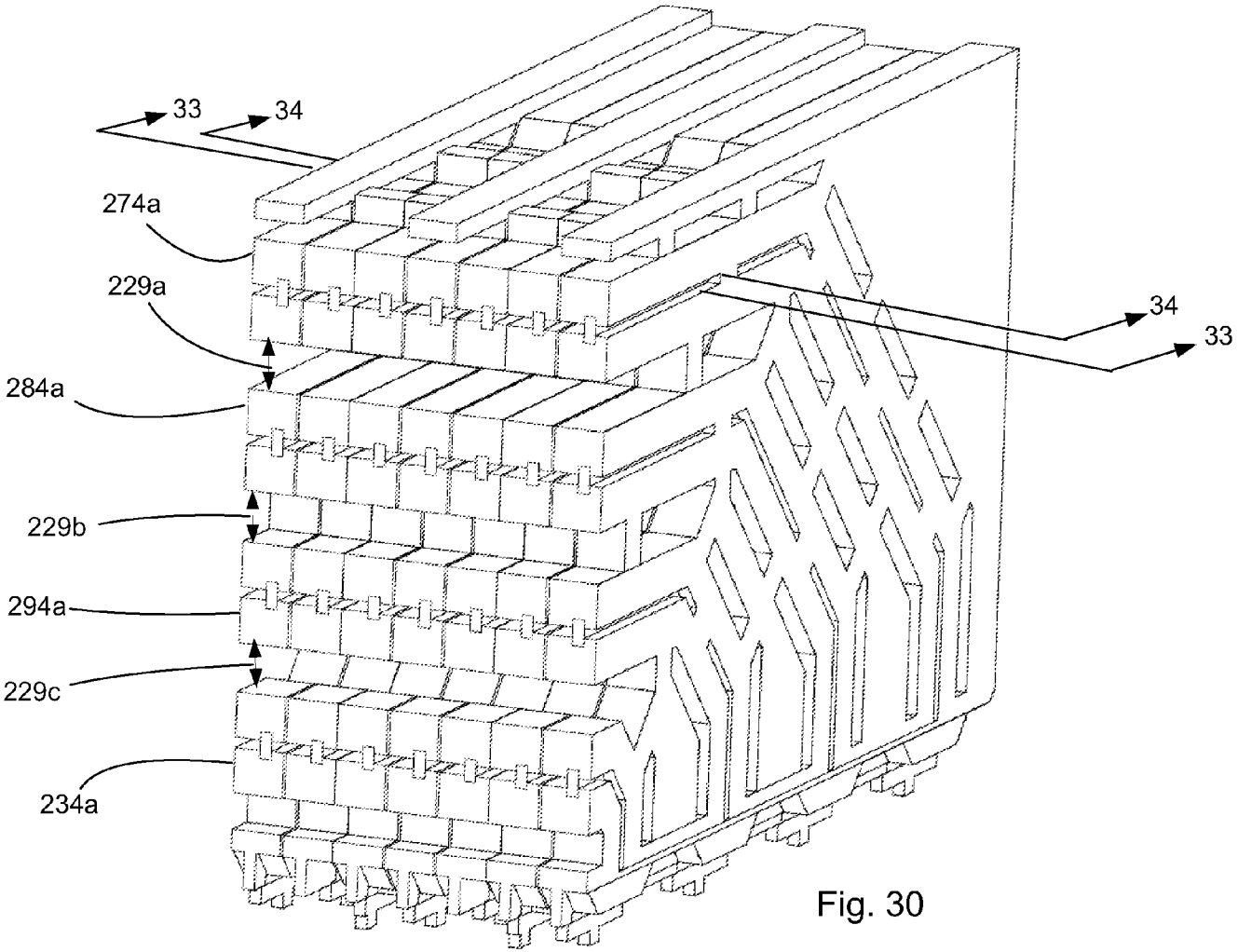
FIG. 30 illustrates a perspective view of a cross section of the embodiment depicted in FIG. 28, taken along line 30-30.
Figure 31:
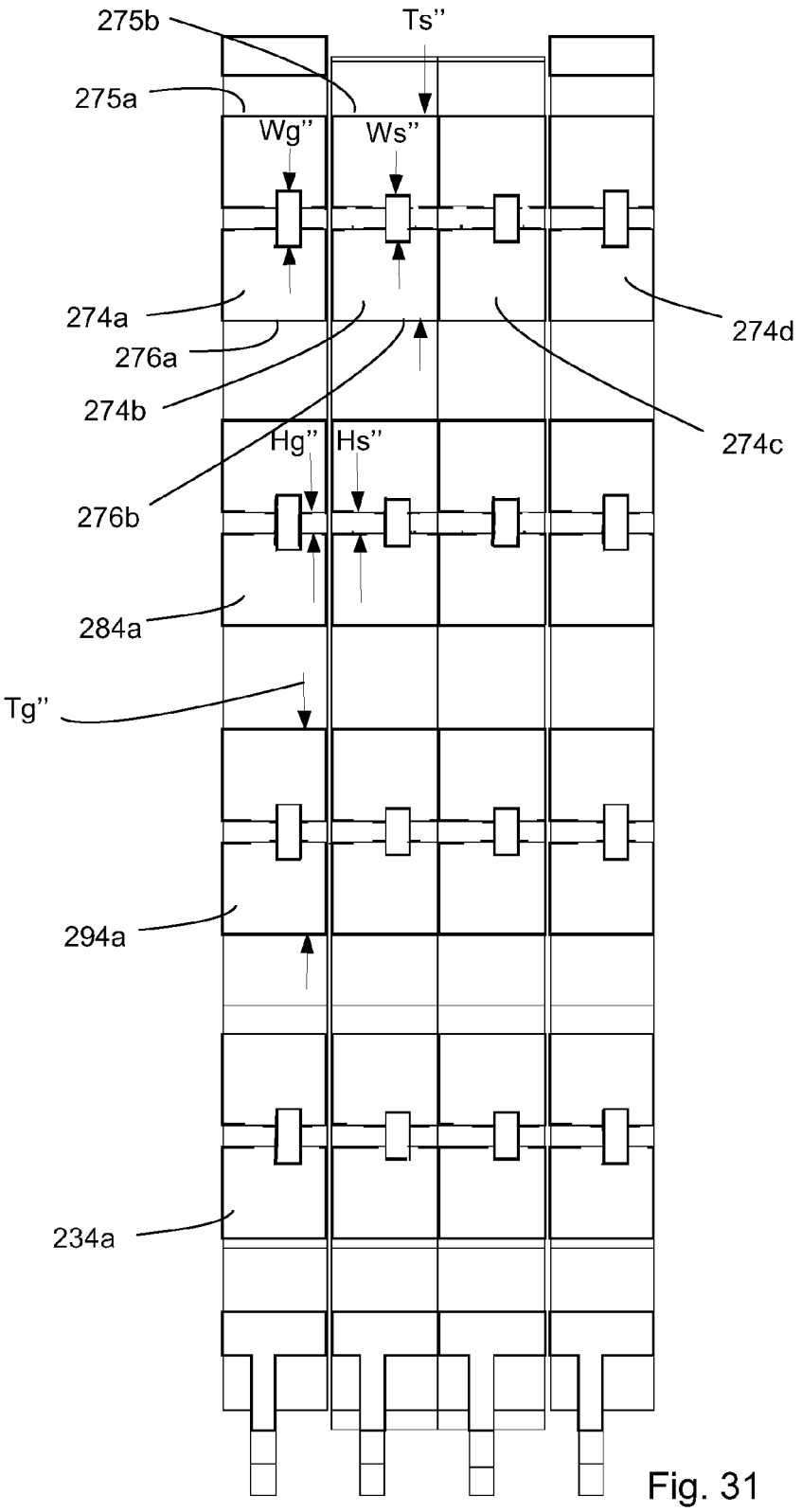
FIG. 31 illustrates an elevated front view of the embodiment depicted in FIG. 30.
Figure 32:
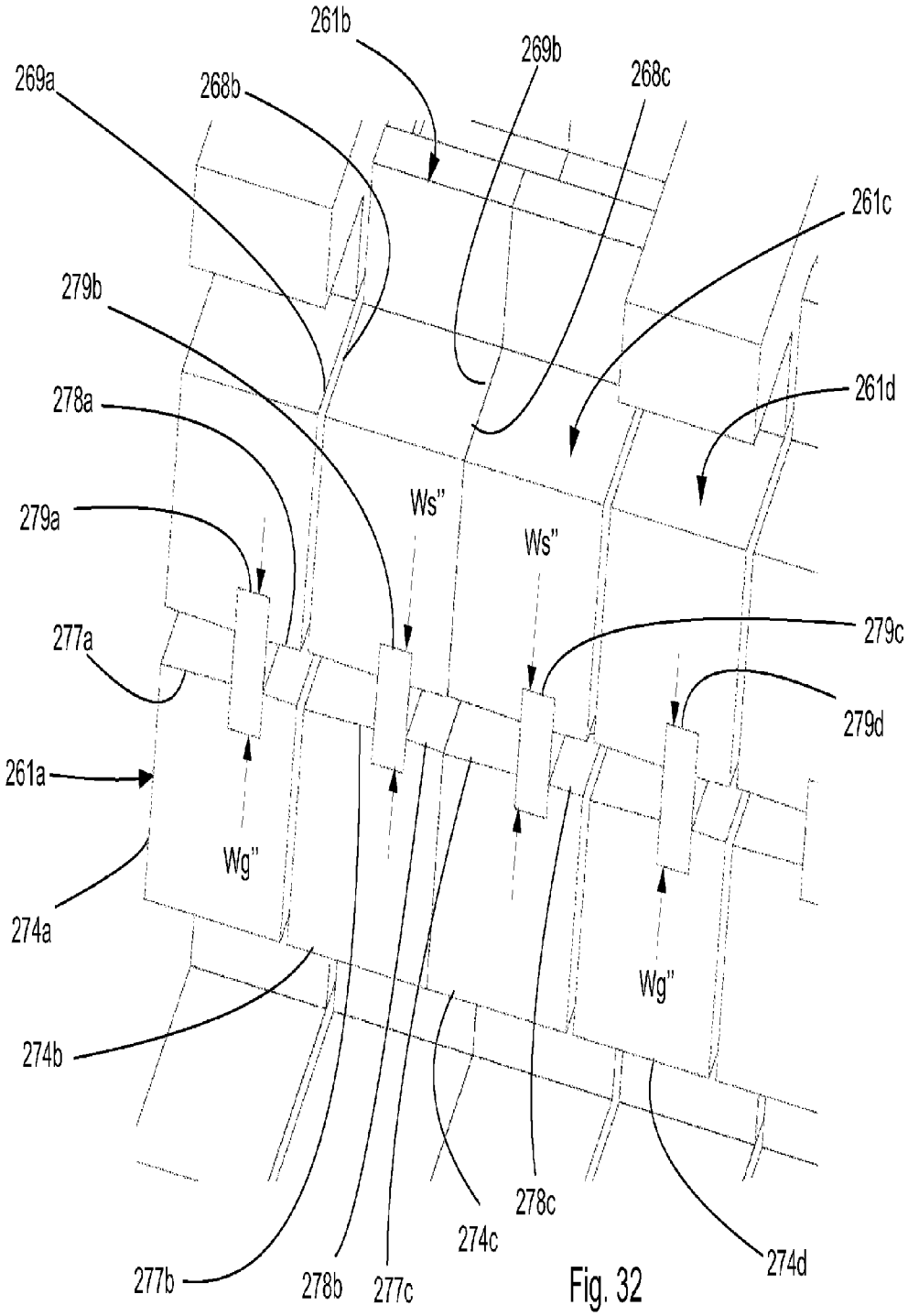
FIG. 32 illustrates a perspective enlarged view of a portion of the embodiment depicted in FIG. 31.

Thus, FIGS. 21-22 represent an embodiment of cross section of a lower transmission channel while FIGS. 23-24 illustrate an embodiment of a cross section of an upper transmission channel. In FIG. 23-24, a height Hs' of an air groove is between signal terminals is less than a height Hg' between a signal/ground or a ground/ground, like height Hs less than height Hg of FIGS. 21-22. The width Ws' of the signal terminals can be equal or less (as shown) than a width Wg' of the ground terminals. However, as above, a thickness Ts' of a truss that supports the signal terminals is greater than (as shown) or equal to a thickness Tg' of the truss that supports the ground terminals.

As with the lower tuned channels, notches N1 can be provided so that the dielectric material is provided in a manner that balances the dielectric material on both sides of centerline C2. The use of the notches N1 thus provides a further enhancement for systems intended for higher data rates and can be used for both the shorter and longer tuned channels. In addition, the use of notches has been found beneficial in system that is on a 0.75 mm pitch.

Part of the benefit of the depicted embodiments is that longer channels inherently have more loss (thus, longer channels obtain less benefit from the increased dampening provided when the wafer-to-wafer gaps are removed). For example, the terminals that are associated with the lower row of terminals in the lower card slot can be less than half the length of the terminals that are associated with the upper row of the top card slot. This difference in channel length tends to cause different issues with respect to managing the performance of respective data channels (an upper and lower data channel, for example). Consequentially, the lower data channel can be configured so that the adjacent wafers are positioned flush against each other (there is substantially no gap between the adjacent trusses). In the upper data channel, however, the frames can be separated by a small distance (such as less than 0.1 mm and potentially less than 0.05 mm) The benefit of providing a variable separation is that the lower port can omit the separation so as to increase damping of the short tuned channel while the upper port, as it has a longer tuned channel, takes advantage of improvement in efficiency provided by the separation as it naturally includes more dampening because of the increased length of the channel. Therefore, the inclusion of a small amount of separation in just the longer channel helps balance the performance of the upper and lower channels with respect to each other.

It should be noted that while the above embodiments include multiple channels in each wafer, in alternative embodiments a wafer might support a single tuned channel. As can be appreciated, the use of the notches and the level of separation would depend on whether there was a need to increase efficiency or add some additional damping to the tuned channel.

FIGS. 25-34 illustrate features of an alternative embodiment of a connector. As can be appreciated, connector 210 (which is a simplified partial embodiment of a full connector) includes a housing 250 (partially depicted so as to provide additional details regarding the construction of wafer set 260) that provides two card slots 251*a*, 251*b* and is supported by PCB 215. In operation, edge cards 214*a*, 214*b* can be supported by a mating connector and inserted into the corresponding card slot so as to affect a mating condition. The connector 210 has the wafer set 260 that includes wafers 261*a*, 261*b*, 261*c* and 261*d* (it being understood that wafer 261*a* and wafer 261*d* may be duplicate wafers, thus effectively providing a wafer pattern of 261*a*, 261*b*, 261*c*, 261*d*, 261*b*, 261*c*, 261*d* where 261*a* and 261*d* are the same wafer).

Each wafer includes four trusses. For example, wafer 261*a* includes truss 274*a*, 284*a*, 294*a* and 234*a* and each truss provides a tuned channel. Four wafers together (in ground, signal, signal, ground configuration) define tuned transmission channels and as depicted, provide four tuned transmission channels spaced apart in a vertical direction in the embodiment depicted in FIG. 30. For example, one tuned transmission channel is defined by truss 274*a*, 274*b*, 274*c* and 274*d*. As depicted, surfaces 275*a* and 276*a* of the truss 274*a* are the configured to be the same as surfaces 275*b* and 276*b* of truss 274*b* (e.g., Tg' is the same as Ts'). In addition, Hg" is the same as Hs" and Tg"=Ts", the width of the terminals 279*a* and 279*b* are not the same, terminal 279*a* having a width Wg" that is greater than width Ws" of terminal 279*b*. Thus, the tuned transmission channel consists of terminal grooves 277*a*, 278*a*, 277*b*, 278*b*, 277*c* and 278*c* being the same height, having trusses with the same thickness and having terminals with different widths for the signal terminals as compared to the ground terminals (it being understood that wafer 261*a* is the same as wafer 261*d*).

While the trusses appear to be similarly sized, it should be noted that the dielectric constant associated with the coupling between each pair of terminals (e.g., G-S or S-S or S-G) is not the same. Specifically, the space between an edge 269*a* of the wafer 261*a* (a ground wafer) and edge 268*b* of wafer 261*b* (a signal wafer) is greater than the space between edge 269*b* of wafer 261*b* and edge 268*c* of wafer 261*c*. The relative offset causes each of the terminals that form the signal pair to be offset from the adjacent ground terminal as compared to their association with each other. Or to put it another way, the dielectric constant associated with the coupling between the pair of terminals that forms the differential pair is different than the dielectric constant associated with the coupling between the signal terminal and the adjacent ground terminal. It is believed that balancing the tuned transmission channel so that this difference is symmetric about the differential pair is beneficial in providing a tuned transmission channel that is capable of high data rates (such as 16 Gbps or even 25 Gbps in a NRZ encoding system). For certain applications, therefore, it is possible to iteratively tune the longer and shorter transmission channels such that the same geometry will work with both transmission channels. However, for certain applications it may be preferred to have different geometries for the shorter and longer tuned transmission channels.

Figure 33:
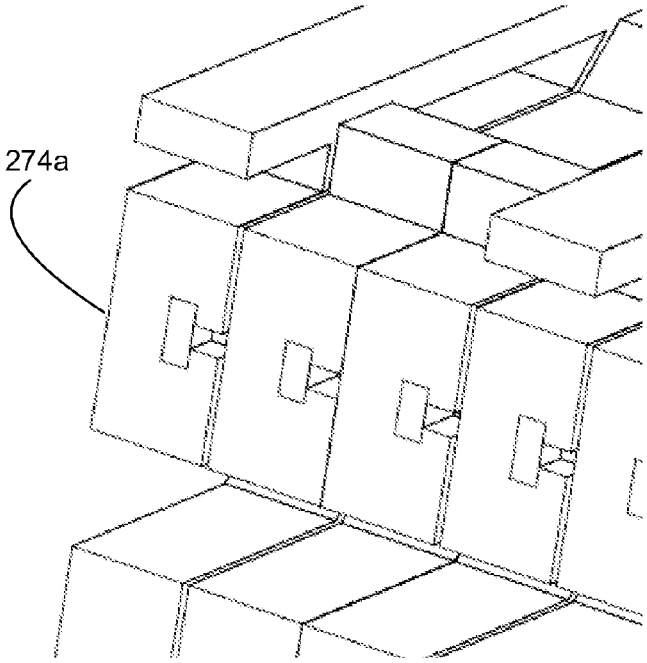
FIG. 33 illustrates a perspective view of a cross-section of the embodiment depicted in FIG. 30, taken along line 33-33.
Figure 34:
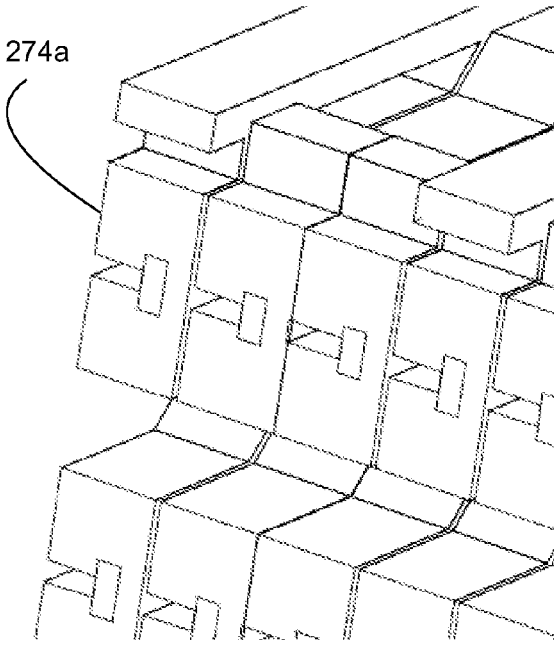
FIG. 34 illustrates a perspective view of a cross-section of the embodiment depicted in FIG. 30, taken along line 34-34.

As can be appreciated, tuning the transmission channel is helpful for applications that are intended to support high data rates. In such applications it is often the case that even minor geometrical changes can have an unintended impact. This means that gaps in grooves and voids in ribs (which are often required to allow for the mold to properly fill) can cause electrical performance issues. To help keep the response of the transmission channels smooth, one potential method of dealing with the issue is depicted in FIGS. 33 and 34. Specifically, the terminal groove is broken by a rib of plastic that acts as the fill line between the two sides of the terminal groove. To minimize the impact of the rib, the rib on a first side is offset from the rib on a second side. This helps minimize changes in the dielectric constant along the path of the transmission channel. In addition, this minimizes the changes to the relative difference in dielectric constant between the ground terminal/signal terminal coupling and the signal terminal/signal terminal coupling.

Figure 35:
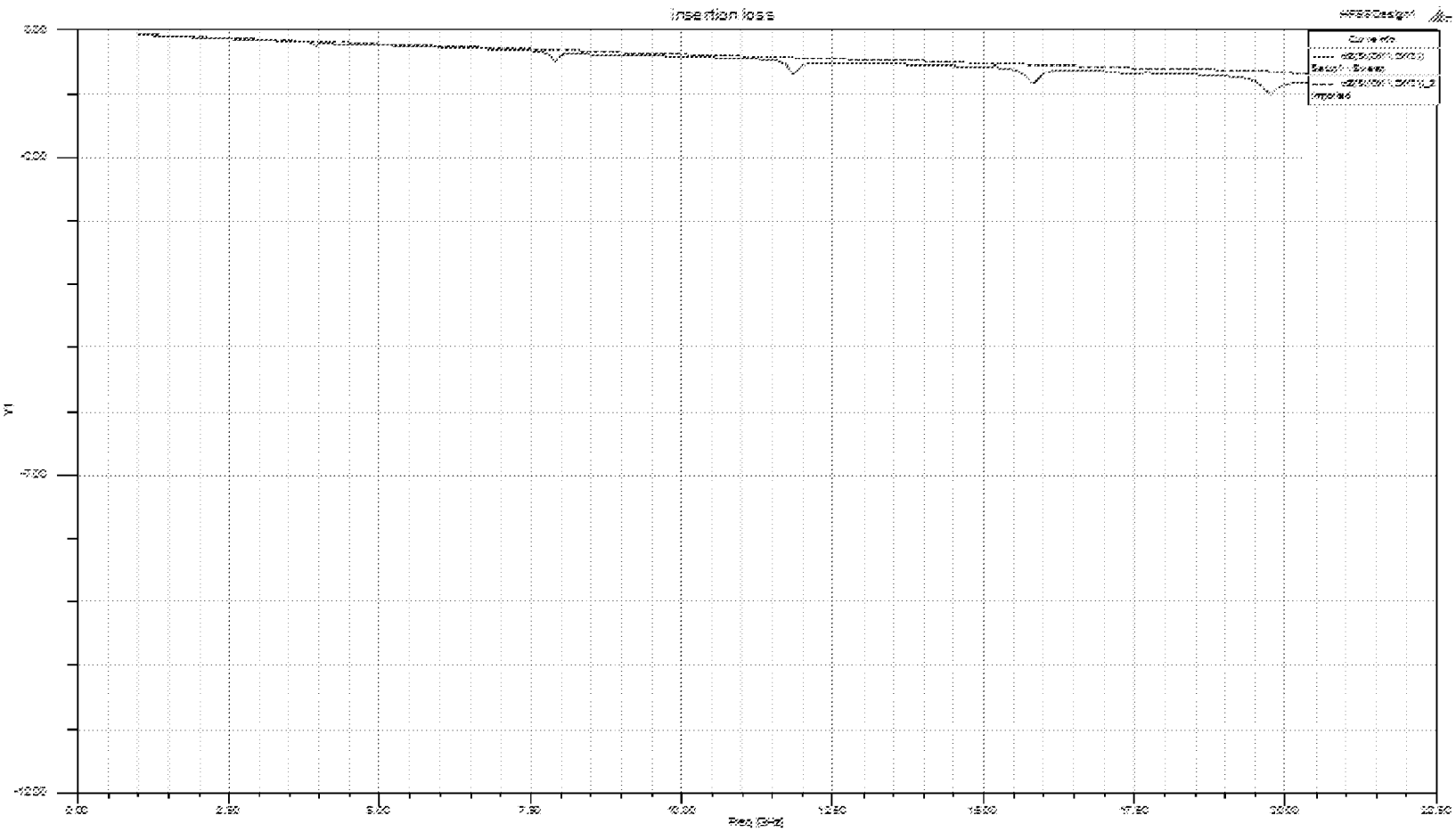
FIG. 35 illustrates a plot of insertion loss on a 12 dB scale.
Figure 36:
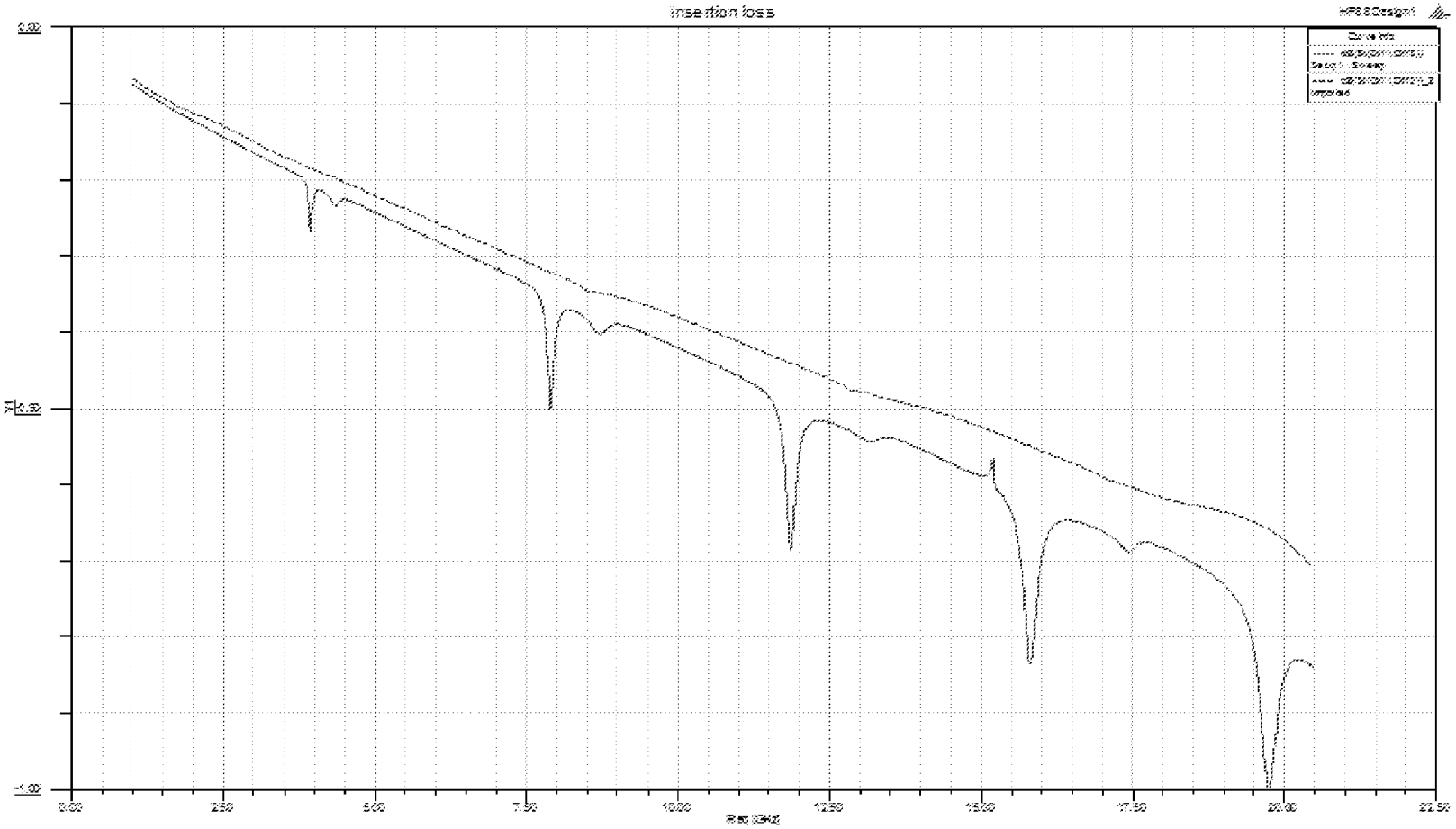
FIG. 36 illustrates a plot of insertion loss on a 1 dB scale.

As can be appreciated from the discussion above, various configurations of the tuned channels can be provided to provide a tuned transmission channel. Dimensions such as the truss thickness, the terminal width, the terminal groove height and wafer-to-wafer gap can all be modified to provide a desired tuned transmission channel To determine whether a channel is suitably tuned, it has been determined beneficial to use a simplified model in ANSYS HSFF software. For example, a simple 25 mm model can be generated in HSFF that includes the geometry of the truss (including its thickness and the terminal groove height) and the terminals. As is known by persons of skill in the art, an insertion loss plot such as is depicted in FIG. 35 can be generated to see if the simple model is suitably tuned. One issue noted by Applicants is that convention methodology of looking at a 10 or 12 dB range for insertion loss causes any dips in insertion loss (which are believed to be resonances that are desirable to remove) to look relatively insignificant. Applicants have determined that reducing the scale to 1 dB as shown in FIG. 36 is helpful in determining whether a transmission channel is desirably tuned.

As can be appreciated, the top broken line indicates a well-tuned transmission channel while the lower line is representative of a transmission channel that is less desirably tuned. More specifically, for channels a dip of 0.2 dB in the frequency range of interest is representative of a resonance that can have a significant negative impact on performance and thus is not a tuned transmission channel. However, if the dips in insertion loss are kept at less than 0.2 dB and more preferably less than 0.1 dB then the transmission channel can be considered a tuned transmission channel. Thus, for an application that that was going to provide 16 Gbps using NRZ encoding, less than a 0.2 dB dip in insertion loss out to 12 GHz is desired and less than 0.1 dB dip in insertion loss is preferred. Furthermore, for an application that that was going to provide 25 Gbps using NRZ encoding, less than a 0.2 dB dip in insertion loss out to about 20 GHz is desired and less than 0.1 dB dip in insertion loss is preferred. As can be appreciated from broken line shown in FIG. 35, with sufficient iterations it is possible to obtain a response that has dips less than 0.05 dB, which is helpful in longer channels.

It should be noted that determining when a transmission channel is tuned is somewhat of an iterative process. Some of the iterations may result because an otherwise tuned transmission channel fails to meet some other parameter (such as desired system impedance or FEXT or NEXT). The ability to test a simple model to verify it can be considered a tuned transmission channel greatly simplifies the design process and can allow for relatively rapid development.

As can be appreciated, therefore, the desired ratio of truss thickness, terminal width, terminal groove height and wafer-to-wafer gap will somewhat depend on the application. For example, if a lower impedance is desired it may be necessary to have wider terminals. Conversely, narrower signal terminals may be necessary to get a higher impedance (such as 100 ohms). Shorter channel lengths may benefit from the inclusion of more plastic so as to provide additional loss (although such loss will be much less than would be experienced if lossy materials were used) while longer channels may benefit from the use of more air. It should also be noted that for certain applications other factors will also implicate whether a transmission channel will function appropriately. Closely positioned wafers (e.g., connectors at very tight pitches such as 0.75 mm or less) or very dense connectors may create a situation where signal pairs are so close to each other as to create undesirable crosstalk. In addition, discontinuities in the structure may cause reflections that create cross-talk. Thus a tuned transmission channel may still fail to function in a desired manner if other design considerations are not taken into account and for short enough channels the benefits of a tuned transmission channel may be secondary as compared to the benefits of reducing cross talk and/or insertion loss (or other related issues). These other considerations are well known to persons of skill in the art of designing connectors suitable for high data rates, however, and thus are not further discussed herein.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing having a card slot;

a first and second signal wafer inserted into the housing, the first wafer having a first terminal supported by a first insulative frame and the second wafer having a second terminal supported by the insulative frame, the first and second terminal each having a tail, a contact and a body extending between the tail and the contact, the first and second terminals configured to provide a broad-side differentially coupled transmission channel that extends substantially through the insulative frames, where the differential coupling mode is in a horizontal arrangement from the contact portion through the body portion;

a third wafer positioned adjacent the first wafer, the third wafer having an insulative frame that supports a third terminal, the third terminal extending along the channel and substantially aligned with the first terminal;

a fourth wafer positioned adjacent the second wafer, the fourth wafer having an insulative frame that supports a fourth terminal, the fourth terminal extending along the channel and substantially aligned with the second terminal;

wherein each of the first, second, third and fourth terminal have a truss of the respective insulative frame that secures upper and lower edges of the terminal, the truss having a corresponding first and second side that provide a corresponding predefined thickness, the thickness defined by a slot on a first side and a slot or edge of the frame on a second side; and a first and second terminal groove extending along both sides of the respective terminal of each of the third and fourth insulative frame, the first and second terminal groove defining an air channel on both sides of the third and fourth terminal, wherein coupling between the terminals of the first and third wafer is less than coupling between the terminals of the first and second wafer.

2. The connector of claim 1, wherein the first insulative frame has a pair of second grooves extending along both sides of the first terminal and the second insulative frame has a pair of second grooves extending along both sides of the second terminal such that each of the terminals is exposed to air along the respective grooves and the adjacent grooves form an air channel that extends between adjacent terminals.

3. The connector of claim 2, wherein the pair of second grooves on both sides of the first and second terminal are a first width and the pair of first grooves on both sides of the third and fourth terminal are a second width different than the first width.

4. The connector of claim 3, wherein the first width is three quarters of the second width.

5. The connector of claim 1, wherein each second groove is a first width, the first width being at least 0.15 mm.

6. The connector of claim 1, wherein each truss that extends along the ground terminals and the signal terminals has a truss width, the truss width of the signal terminals being not less than the truss width of the ground terminals.

7. The connector of claim 6, wherein the truss width of the signal terminals is greater than the truss width of the ground terminals.

8. A connector, comprising:

a housing with a mating side and a mounting side, the housing including a first and second card slot on a mating side, the first card slot being arranged above the second card slot in a vertical arrangement;

a first and second signal wafers inserted into the housing, the first wafer having a first and second terminal supported by a first insulative frame and the second wafer having a third and fourth terminal supported by a second insulative frame, the terminals each having a tail, a contact and a body extending between the tail and the contact, the first and third terminals configured to provide a broad-side differentially coupled upper channel that extends substantially through the insulative frames from the first card slot to the tails, the second and fourth terminals configured to provide a broad-side differentially coupled lower channel that extends substantially through the insulative frames from the second card slot to the tails, where the differential coupling mode is in a horizontal arrangement from the contact portion through the body portion; and a first, second, third and fourth truss formed in the insulative frame, the first truss supporting the first terminal, the second truss supporting the second terminal, the third truss support the third terminal and the fourth truss supporting the fourth terminal, each truss securing upper and lower edges of the respective terminal, the first, second, third and fourth trusses being defined on both an upper and lower side by one of either a slot that extends through the insulative wafer and an edge of the respective insulative wafer.

9. The connector of claim 8, wherein the first and second wafer are configured to be mated in the housing such that substantially no air gap exists between the first and second insulative housing along the second channel.

10. The connector of claim 9, wherein the first and second wafer are configured such that a predetermined air gap exists between the first and second insulative housing along the first channel.

11. The connector of claim 8, wherein each of the trusses have a terminal groove on each side of the terminal.

12. The connector of claim 11, wherein the terminal grooves between two adjacent signal terminals have a first width and the terminal groves between adjacent signal and ground terminals has a second width, the first width being less than the second width.

13. A connector, comprising:

a first wafer with a first terminal;

a second wafer with a second terminal positioned adjacent the first wafer;

a third wafer with a third terminal positioned adjacent the second wafer;

a fourth wafer with a fourth terminal positioned adjacent the third wafer, wherein the first through fourth wafer are in series and the four terminals are each supported by a truss so as to provide a ground, signal, signal, ground tuned transmission channel configured to provide a dip in insertion loss of less than 0.2 dB between 0 and 12 GHz when tested in a simplified 25 mm long model using ANSYS HSFF software.

14. The connector of claim 13, wherein the dip in insertion loss is less than 0.1 dB.

15. The connector of claim 13, wherein the dip in insertion loss is less than 0.2 dB out between 0 and 20 GHz.

16. The connector of claim 15, wherein the dip in insertion loss is less than 0.1 dB.

17. The connector of claim 15 wherein the dip in insertion loss is less than 0.05 dB.

18. The connector of claim 13, further comprising a receptacle configured to provide suitable EMI shield for the desired signaling frequency of operation.

* * * * *